US005527135A

United States Patent [19]

Hayashi et al.

[11] Patent Number: 5,527,135

[45] Date of Patent: Jun. 18, 1996

[54] METHOD FOR INJECTING LUBRICANT OR BACK-FILLING MATERIAL INTO A SPACE BETWEEN THE OUTSIDE OF DOUBLE-WALL PIPES AND THE GROUND IN THE PIPE-JACKING METHOD AND AN APPARATUS THEREFOR

[75] Inventors: Mitsutoshi Hayashi, Saitama-ken; Akitaka Fujita, Tokyo; Shingo Nagashima, Tokyo; Minoru Kurashina, Tokyo; Makoto Kajiyama, Zama; Hideki Uno, Tokorozawa, all of Japan

[73] Assignees: Kabushiki Kaisha Iseki Kaihatsu Koki; Tokyo Gas Co., Ltd., both of Tokyo, Japan

[21] Appl. No.: 196,369

[22] Filed: Feb. 15, 1994

[30] Foreign Application Priority Data

| | | | |
|---|---|---|---|
| Mar. 3, 1993 | [JP] | Japan | 5-065943 |
| Mar. 3, 1993 | [JP] | Japan | 5-065948 |
| Mar. 22, 1993 | [JP] | Japan | 5-085112 |
| Mar. 22, 1993 | [JP] | Japan | 5-085113 |
| Mar. 30, 1993 | [JP] | Japan | 5-093866 |

[51] Int. Cl.[6] ..... F16L 1/00

[52] U.S. Cl. ..... 405/184; 405/141

[58] Field of Search ..... 405/138, 141, 405/145, 154, 184

[56] References Cited

U.S. PATENT DOCUMENTS

| | | | |
|---|---|---|---|
| 1,235,233 | 7/1917 | O'Rourke | 405/141 |
| 3,589,135 | 6/1971 | Ede | 405/184 |
| 4,063,425 | 12/1977 | Jutte et al. | 405/145 |
| 4,147,453 | 4/1979 | Unger et al. | 405/141 |
| 4,728,223 | 3/1988 | Rice | 405/154 |
| 4,956,032 | 9/1990 | Hahn et al. | 405/154 X |
| 5,221,160 | 6/1993 | Azuma et al. | 405/138 |

FOREIGN PATENT DOCUMENTS

| | | | |
|---|---|---|---|
| 3015210 | 11/1981 | Germany | 405/145 |

*Primary Examiner*—Terry Lee Melius
*Assistant Examiner*—John A. Ricci
*Attorney, Agent, or Firm*—Townsend & Banta

[57] ABSTRACT

A conduit comprised of double-wall pipes A is laid in the ground by the pipe-jacking method. Each of double-wall pipes A comprises inner pipe 1 and outer pipe 2 and is provided with sheath pipe 4 between inner pipe 1 and outer pipe 2 and with check valve 7. Winch 11 is mounted in tunneling machine 6. Wire 12 wound on winch 11 is inserted into sheath pipe 4 and the forward end of wire 12 is sent to start vertical shaft C through sheath pipe 4, and connected with cleaning member 24, injecting member F, and supply pipe 14. Cleaning member 21, injecting member F, and supply pipe 14 are moved in sheath pipes 4 by driving winch 7. When injecting member F is opposed to check valve 7, packing means 19, 20 are inflated to be brought into contact with the inside of sheath pipe 4 by which injecting member F is fixed to sheath pipe 4. Lubricant or back-filling material is sent to a space between packing means in sheath pipe 3, and injected through check valve 7 into space 9 between the outside of outer pipe 2 and the ground.

17 Claims, 19 Drawing Sheets

METHOD FOR INJECTING LUBRICANT OR BACK-FILLING MATERIAL INTO A SPACE BETWEEN THE OUTSIDE OF DOUBLE-WALL PIPES AND THE GROUND IN THE PIPE-JACKING METHOD AND AN APPARATUS THEREFOR

BACKGROUND OF THE INVENTION

1. Field of the Invention

The present invention relates to a method of injecting lubricant or back-filling material into a space between the outside of double-wall pipes and the ground by laying a conduit comprised of double-wall pipes each of which comprises an inner pipe and an outer pipe, by supplying lubricant or back-filling material to a check valve mounted in an outer pipe of a double-wall pipe, through a lubricant or back-filling material supply pipe introduced through sheath pipes each of which is provided between an inner pipe and an outer pipe of each double-wall pipe, and injecting lubricant or back-filling material into a space between the outside of double-wall pipes and the ground through the check valve, while laying a conduit in the ground, and to a method of injecting back-filling material into a space between the outside of double-wall pipes and the ground by laying a conduit comprised of double-wall pipes each of which comprises an inner pipe and an outer pipe, and thereafter supplying back-filling material to each check valve mounted in an outer pipe of each double-wall pipe through a back-filling material supply pipe introduced through sheath pipes each of which is provided between the inner pipe and the outer pipe of each double-wall pipe, and injecting back-filling material through each check valve into a space between the outside of each double-wall pipe and the ground, and further to an apparatus for injecting lubricant or back-filling material into a space between the outside of double wall pipes and the ground.

2. Description of the Prior Art

Laying sewer conduit or service water conduit in the ground is carried out by tunneling through the ground by a tunneling machine, while the tunneling machine followed by pipes such as Hume pipes and steel pipes is propelled by a pipe-jacking machine, wherein it is carried out to inject lubricant into a space between the outside of the tunneling machine and the ground and between the outside of pipes and the ground. Further, in the above-mentioned pipe-jacking method, it is also carried out to inject back-filling material into a space between the outside of pipes forming a conduit and the ground, after having laid the conduit.

Each of the pipes with a diameter over 800 mm used in the above-mentioned pipe-jacking method is formed with a hole at a given position. The hole is connected through a hose with a lubricant or back-filling material feeder, which is provided on the ground. While propelling pipes, lubricant is injected into a space between the outside of pipes and the ground, by supplying lubricant through the hose to the hole and injecting lubricant into the space through the hole so that frictional force can be decreased, or after having laid a desired conduit in the ground, back-filling material is injected into a space between the outside of the pipes and the ground so that the space between the outside of the pipes and the ground is filled with back-filling material.

On the other hand, there is a case where a conduit for supplying gas such as coal, gas or fuel and natural gas and others is laid in the ground. Since a gas pipe requires the securest tightness, gas pipes are connected to each other by mutually welding the edges of pipes, wherein the weld is inspected by non-destructive inspection about whether a conduit for supplying gas without a welding defect is formed.

Since a gas pipe requires the higher gas tightness, it is thought that a gas pipe cannot be provided with a hole for injecting lubricant or back-filling material to a space between the outside of pipes and the ground. Further, it is thought that the edge of a gas pipe cannot be brought into immediate contact with a push ring of a pipe-jacking machine so that the gas pipes cannot be propelled by a pipe-jacking machine, because there is the possibility that the edge of the gas pipe will be damaged by the push ring.

Since there is the above-mentioned problem, when laying a conduit for gas, in general, a conduit comprised of Hume pipes with the diameter sufficiently larger than the outside of the gas pipe is first laid by the pipe-jacking method, and a space between the outside of the conduit comprised of Hume pipes and the ground is filled with back-filling material, then a conduit for gas supply comprised of gas pipes is formed within the conduit comprised of Hume pipes.

Recently, it was developed that double-wall pipes each of which is composed of an outer pipe and an inner pipe inserted into the outer pipes are prefabricated, and thrust is applied to the outer pipes from a pipe-jacking machine so that the inner pipes and the outer pipes can be simultaneously propelled. In this pipe-jacking method, every time an individual double-wall pipe is propelled into the ground, the edge of an inner pipe of the individual double-wall pipe which has been propelled into the ground is welded with the edge of a new individual double-wall pipe which is disposed in a start vertical shaft so that a conduit comprised of inner pipes with the securest tightness can be laid by one pipe-jacking method.

BRIEF SUMMARY OF THE INVENTION

It is an object of the present invention to provide a method of injecting lubricant between the outside of double-wall pipes and the ground while propelling double-wall pipes having the above-mentioned structure, and after having laid a conduit comprised of double-wall pipes, injecting back-filling material between the outside of double-wall pipes and the ground.

It is a second object of the present invention to provide another method of injecting lubricant between the outside of double-wall pipes and the ground while propelling double-wall pipes having the above-mentioned structure, and after having laid a conduit comprised of double-wall pipes, injecting back-filling material between the outside of double-wall pipes and the ground.

It is a third object of the present invention to provide a method of easily moving the head of a lubricant or back-filling material supply pipe to the desired position, in a sheath pipe provided between an inner pipe and an outer pipe of each double-wall pipe, within a short time, and an apparatus therefor.

It is a fourth object of the present invention to provide a method of injecting lubricant or back-filling material into a space between the outside of double-wall pipes and the ground without being influenced by an elongation of a lubricant or back-filling material supply pipe, even if the elongation of a lubricant or back-filling material supply pipe is generated in drawing the lubricant or back-filling material supply pipe in a sheath pipe provided between an inner pipe and an outer pipe of each double-wall pipe, and an apparatus therefor.

It is a fifth object of the present invention to provide a method of easily drawing a lubricant or back-filling material supply pipe into sheath pipes each of which is provided between an inner pipe and an outer pipe of each double-wall pipe.

It is a sixth object to provide a method of easily moving a lubricant or back-filling material supply pipe in sheath pipes each of which is provided between an inner pipe and an outer pipe of each pipe, even if there is foreign matter within the sheath pipes.

It is a seventh object to provide a method of injecting back-filling material into a space between the outside of double-wall pipes and the ground, after having laid a conduit comprised of double-wall pipes in the ground.

To achieve the first object of the present invention, the present invention is characterized in that each double-wall pipe comprises an inner pipe and an outer pipe, a sheath pipe disposed between the inner pipe and the outer pipe, and an intermediate layer which is formed in a space between the inner pipe, the outer pipe and the sheath pipe in such a manner that the outside of an end of the inner pipe is not covered by the intermediate layer, a backward end of a first double-wall pipe which has been propelled is disposed to be projected into a start vertical shaft, and an inner pipe of the double-wall pine is connected with an inner pipe of a second double-wall pipe which is disposed in the start vertical shaft, while the sheath pipe of the first double-wall pipe is connected with the sheath pipe of the second double-wall pipe through a T-typed joint, then a space formed between an end of the first double-wall pipe and an end of the second double-wall pipe is covered by outer pipes of the first and second double-wall pipes or a covering member, while the outer pipes of the first and second double-wall pipes or the covering member is provided with a check valve, which is connected with the T-typed joint, and thereafter the above-mentioned space is filled with back-filling material, and then a conduit comprised of double-wall pipes is laid by injecting a lubricant injecting member into a space between the outside of double-wall pipes and the ground by inserting a lubricant injecting member into the sheath pipes and moving to dispose it to a suitable position, and injecting lubricant into a space between the outside of double-wall pipes and the ground through a given T-typed joint, and thereafter back-filling material is injected into a space between the outside of double-wall pipes and the ground through a back-filling material injecting member.

According to the present invention, it is possible to smoothly propel double-wall pipes by decreasing frictional resistance between the outside of double-wall pipes and the ground, and further it is possible to inject back-filling material into a space between the outside of double-wall pipes and the ground.

Namely, since a sheath pipe is prefabricated in an intermediate layer formed between an inner pipe and an outer pipe of each double-wall pipe, it is possible to selectively insert a lubricant injecting member or a back-filling member into the sheath pipe while propelling double-wall pipes, or after having propelled double-wall pipes.

Further, since an inner pipe of a first double-wall pipe which has been propelled is connected with an inner pipe of a second double-wall pipe which is disposed in the start vertical shaft, while sheath pipes of the first and second double-wall pipes are connected with each other through a T-typed joint, it is possible to hold the first and second double-wall pipes together as a unit, while connecting sheath pipes of the first and second double-wall pipes with each other.

Accordingly, while double-wall pipes are propelled, lubricant can be injected into a space between the outside of outer pipes and the ground through the T-typed joint and outer pipes or a covering member. Further, after a conduit comprised of double-wall pipes has been laid between a start vertical shaft and an arrival vertical shaft, the inside of sheath pipes is filled with back-filling material which is supplied from a injecting material supply member, while back-filling material is injected into a space between the outside of outer pipes and the ground.

To achieve the second object of the present invention, the present invention is characterized in that each double-wall pipe comprises an inner pipe and an outer pipe, a sheath pipe which is disposed between the inner pipe and the outer pipe and an intermediate layer which is formed in the space between the inner pipe, the outer pipe and the sheath pipe in such a manner that the outside of an end of the inner pipe is not covered by the intermediate layer, and a check valve is mounted in an end of the outer pipe, a backward end of a first double-wall pipe which has been propelled is disposed to be projected into a start vertical shaft, and the inner pipe of the double-wall pipe is connected with an inner pipe of a second double-wall pipe which is disposed in the start vertical shaft, then a space formed between the first double-wall pipe and second double-wall pipe is covered by the outer pipes of the first and second double-wall pipes or a covering member, and a conduit is laid by propelling double-wall pipes while lubricant is injected into a space between the outside of double-wall pipes and the ground a given T-typed joint by inserting a lubricant injecting member into the sheath pipe and moving to dispose it to a suitable position, and thereafter back-filling material is injected into the space between the outside of the outer pipes and the ground.

Namely, by connecting a first double-wall pipe with a second double-wall pipe and covering an outer pipe of the first and second double-wall pipes, openings of sheath pipes of the first and second double-wall pipes can be disposed within the space formed between an end of the first double-wall pipe and an end of the second double-wall pipe, and a check valve can be positioned within the above-mentioned space.

Accordingly, lubricant can be injected into a space between the outside of outer pipes and the ground through a check valve mounted in outer pipes of the first and second double-wall pipes or a covering member. Further, after a conduit comprised of double-wall pipes has been laid between a start vertical shaft and an arrival vertical shaft, back-filling material can be injected into a space between the outside of outer pipes and the ground from a back-filling material injecting member inserted into sheath pipes.

To achieve the third object of the present invention, the present invention is characterized in that a wire is inserted into a sheath pipe provided between an inner pipe and an outer pipe of a double-wall pipe, from one terminal end toward the other terminal end of the sheath pipe, and the wire is connected with a lubricant or back-filling material supply pipe, thereafter the wire is wound so that the lubricant or back-filling material supply pipe is drawn by the wire in the sheath pipe to the position at which an outlet of the lubricant or back-filling material supply pipe is opposed to a check valve mounted in the outer pipe, when lubricant or back-filling material is supplied to the check valve through the lubricant or back-filling material supply pipe, and the supplied lubricant or back-filling material is injected through the check valve into a space between the outside of the double-wall pipe and the ground.

According to the above-mentioned invention, without recourse to hand work, the lubricant supply pipe or the back-filling material supply pipe can be inserted so that the outlet of the lubricant supply pipe or the back-filling material supply pipe reaches the desired position.

To be more precise, when an individual double-wall pipe is propelled, a wire unwound from a winch mounted in a tunneling machine is preliminarily inserted into the sheath pipe, and the wire is connected with a terminal end of the lubricant or back-filling material supply pipe provided in a start vertical shaft. Then, the tunneling machine followed by a double-wall pipe or double-wall pipes is propelled by a pipe-jacking machine, while the ground is excavated by the tunneling machine, and at the same time, the wire is wound onto the winch so that together with winding of the wire, the lubricant or back-filling material supply pipe is drawn out into the sheath pipe. Further, the lubricant or back-filling material supply pipe is provided with scale marks in the longitudinal direction thereof so that the length by which the lubricant or back-filling material supply pipe is drawn out can be read from the scale marks so that the head portion of the lubricant or back-filling material supply pipe can be detected while propelling double-wall pipes.

Accordingly, when the ahead portion of the lubricant or back-filling material supply pipe reaches the position at which the head portion is opposed to a check valve mounted in an outer pipe of a double-wall pipe, lubricant or back-filling material can be injected to a space between the outside of double-wall pipes and the ground by driving the lubricant or back-filling material feeder.

Further, to achieve the second object of the present invention, the invention is characterized in that a lubricant or back-filling material supply pipe, which is provided with an injecting member having two packing means arranged at a given interval and an outlet thereof disposed between the two packing means, is moved in a sheath pipe provided between an inner pipe and outer pipe of a double-wall pipe to a position in which the injecting member is opposed to a check valve provided in the outer pipe, and when the injecting member reaches the above-mentioned position, the two packing means are inflated so that the inside of the sheath pipe can be partitioned by the two packing means and thereby the injecting member can be fixed to the sheath pipe, and thereafter, lubricant or back-filling material is injected through the lubricant or back-filling material supply pipe and the check valve to a space between the outside of double-wall pipes and the ground.

According to the above-mentioned invention, the injecting member with the outlet disposed between the two packing means can be opposed to the check valve of double-wall pipe, even if an elongation of the lubricant supply pipe or the back-filling material supply pipe is generated when it is drawn in the sheath pipe.

To be more precise, when lubricant or back-filling material is injected to a space between the outside of double-wall pipes and the ground, the inside of the sheath pipe is partitioned by the two inflated packing means. Accordingly, if the check valve is positioned between the two packing means, lubricant or back-filling material can be surely injected through the check valve to a space between the outside of double-wall pipes and the ground. Particularly, lubricant or back-filling material can be easily injected from the outlet of the injecting member to the inside of the sheath pipe partitioned by the two packing means without being influenced by an elongation of the lubricant supply pipe or the back-filling material supply pipe by setting an interval between the two packing means to the length of an individual double-wall pipe or more.

Further, to achieve the third object of the present invention, the present invention is characterized in that a lubricant or back-filling material supply pipe is moved in sheath pipes each of which is provided between an inner pipe and an outer pipe of each double-wall pipe, while lubricant or back-filling material is intermittently injected from the outlet of the injecting member to the inside of the sheath pipes while the lubricant or back-filling material supply pipe is moved in the sheath pipe.

According to the above-mentioned invention, the lubricant or back-filling material supply pipe is drawn in the sheath pipes, while lubricant or back-filling material is intermittently injected to the inside of the sheath pipes so that the lubricant or back-filling material act as a lubricant interposed between the sheath pipes and injecting member, thereby the winch being able to be miniaturized, and an elongation of the lubricant or back-filling material supply pipe being able to be decreased.

Further, to achieve the fourth object of the present invention, the invention is characterized in that an injecting member is connected with a cleaning member which is brought into contact with the inner surface of sheath pipes each of which is provided between an inner pipe and an outer pipe of each double-wall pipe so that the inner surface of sheath pipes can be cleaned by the cleaning member while drawing the lubricant or back-filling material in the sheath pipe.

According to the above-mentioned invention, the inner surface of the sheath pipes can be cleaned by the cleaning member while drawing the lubricant or back-filling material supply pipe into sheath pipes. Thereby, the inside of the sheath pipe can be always kept cleaned so that the lubricant supply pipe or the back-filling material supply pipe can be easily drawn. In particular, the inside of sheath pipes can be cleaned by using the cleaning member made of flexible material.

Further, to achieve the fifth object of the present invention, the invention is characterized in that a back-filling material supply pipe provided with an injecting member at the forward end thereof is inserted into sheath pipes each of which is provided between an inner pipe and an outer pipe of each double-wall pipe, which double-wall pipes form a conduit which has been laid between a start vertical shaft and an arrival vertical shaft and are provided with check valves in outer pipes thereof respectively, from a side of one vertical shaft, until an outlet of the injecting pipe reaches a position where the outlet is opposed to a check valve which is situated at about a center of the conduit, at which back-filling material is injected into a space between the outside of double-wall pipes and the ground through the outlet of the injecting pipe and the check valve which is situated at about the center of the conduit, and then the back-filling material supply pipe is drawn back toward the side of one vertical shaft, while back-filling material is injected into a space between the outside of double-wall pipes and the ground through the outlet of the injecting pipe and a check valve which is opposed to the outlet of the injecting pipe, by which the space between the outside of double-wall pipes corresponding to half of the length of the conduit and the ground is filled with back-filling material, and thereafter the back-filling material supply pipe is inserted into the sheath pipe from a side of the other vertical shaft until the outlet of the injecting pipe reaches a position where the outlet is opposed to a check valve which is situated at the inner most portion of the conduit from a side of the other vertical shaft, at which back-filling material is injected into a space between the outside of double-wall pipes and the ground, and then the back-filling material supply pipe is drawn back toward the side of the other vertical shaft, while back-filling material is injected into a space between the outside of double-wall pipes and the ground through the outlet of the injecting pipe and a check valve which is opposed to the outlet of injecting pipe, by which the space between the outside of double-wall pipes corresponding to the full length of the conduit and the ground is filled with back-filling material.

According to the present invention, since operations for injecting back-filling material into a space between the outside of the conduit which has been laid and the ground are conducted both with inserting a back-filling material supply pipe into sheath pipes of double-wall pipes from a side of one vertical shaft and with inserting the back-filling material supply pipe into sheath pipes of double-wall pipes from a side of the other side, back-filling material pipe may have nearly half the length of the conduit. Therefore, the length of the back-filling material supply pipe can be shortened as compared with a case where back-filling material is injected into a space between the outside of the conduct and the ground over the full length of the conduit from a side of one vertical shaft to a side of the other vertical shaft so that the frictional force between the back-filling material supply pipe and the sheath pipe can be reduced and the diameter of the back-filling material supply pipe can be made small.

Accordingly, a back-filling material feeder, for example the pressure pump's ability can be increased and a winder of the back-filling material supply pipe can be small-sized. Further, an outer pipe of the double-wall pipe can be made thin while the size of an inner pipe thereof can be maintained.

DETAILED DESCRIPTION OF THE PREFERRED EMBODIMENT

Figure 1:
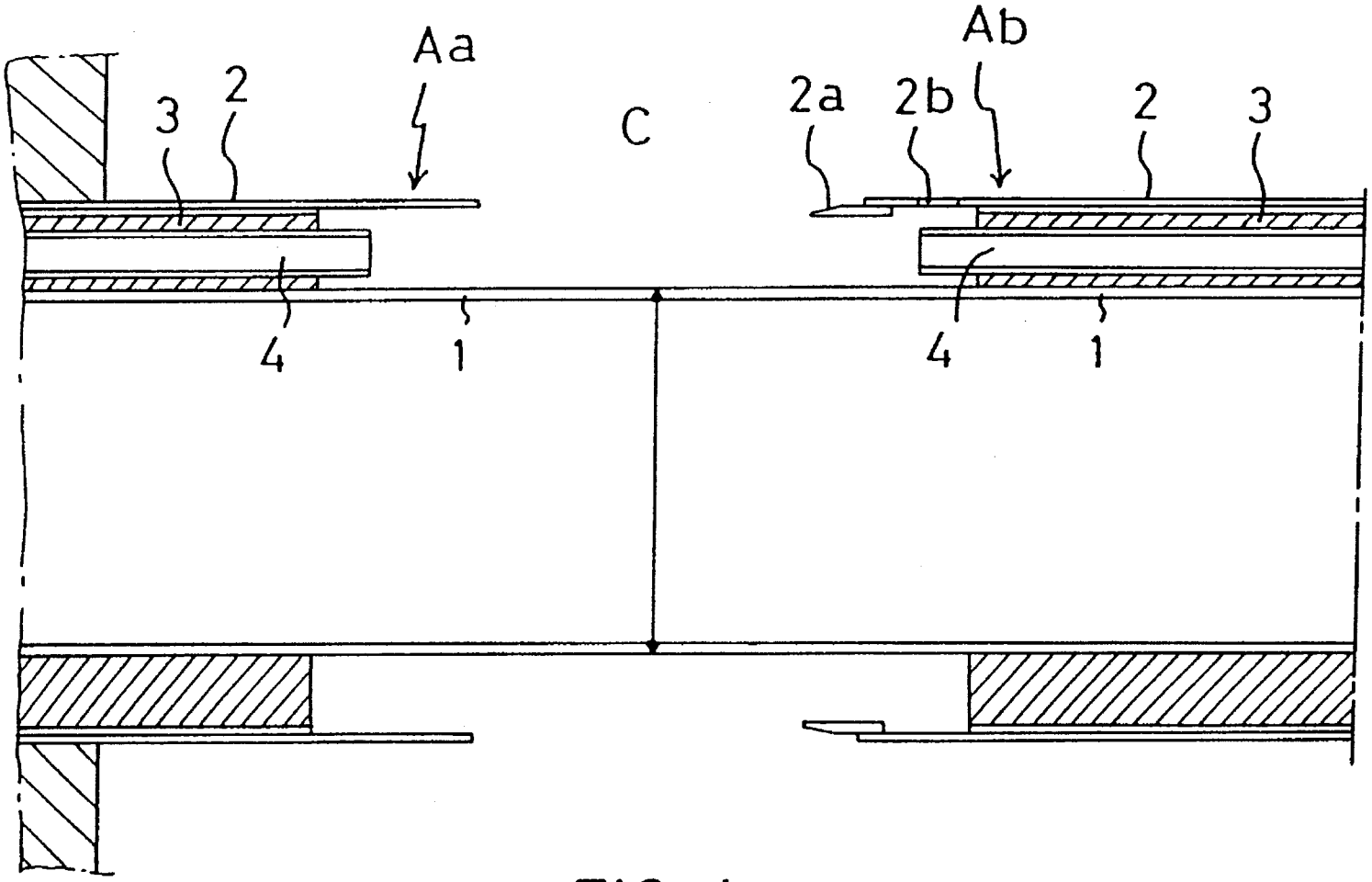
FIG. 1 is a sectional view for showing a state in which an inner pipe of a first double-wall pipe which has been propelled is connected with an inner pipe of a second double-wall pipe which is disposed in a start vertical shaft.

First, the structure of double-wall pipe A is explained. Double-wall pipe A comprises inner pipe 1 and outer pipe 2. Intermediate layer 3 composed of mortar or plastic foams is formed between inner pipe 1 and outer pipe 2. Inner pipe 1 is connected with outer pipe 2 through intermediate layer 3 so that inner pipe 1 is movable with respect to outer pipe 2 both in the longitudinal axial direction and in the circumferential direction.

However, double-wall pipe A is not restricted to the above-mentioned structure. Inner pipe 1 may be held by means of brackets (not shown ) provided between inner pipe 1 and outer pipe 2 so that inner pipe 1 is movable relatively to outer pipe 2 both in the longitudinal direction and in the circumferential direction.

Inner pipe 1 and outer pipe 2 are made of steel pipe with the preset diameter and length, respectively. In the embodiment of the invention, double-wall pipe A is provided with a view to supplying combustible gas wherein inner pipe 1 requires the higher airtightness. Therefore, when new double-wall pipe Ab is connected to double-wall pipe Aa which has been propelled, inner pipe 1 of new double-wall pipe Ab and double-wall pipe Aa which has been propelled are welded to each other all the circumference.

Therefore, the length of intermediate layer 3 is shorter than that of inner pipe 1 by the distance required to weld ends of inner pipes 1 with each other. Both ends of inner pipe 1 are not covered by intermediate layer 3 to be exposed. One or plural sheath pipes 4 are provided in the longitudinal direction between inner pipe 1 and outer pipe 2.

Then, the procedure of propelling the above-mentioned double-wall pipe A is explained. First, a first double-wall pipe Aa is propelled to such a position that an end of inner pipe of the propelled first-wall pipe Aa is projected into a start vertical shaft by a pipe-jacking machine, and then the pipe-jacking machine is returned, and thereafter a second double-wall pipe Ab is disposed in the start vertical shaft Ab. Then, as shown in FIG. 1, the end of inner pipe 1 of double-wall pipe Aa is brought into contact with an end of inner pipe 1 of the second double-wall pipe Ab, and welded thereto. The weld is inspected by non-destructive inspection about whether a conduit for supplying gas without welding defect is formed. Thereby inner pipes 1 are held together in a unit.

Figure 2:
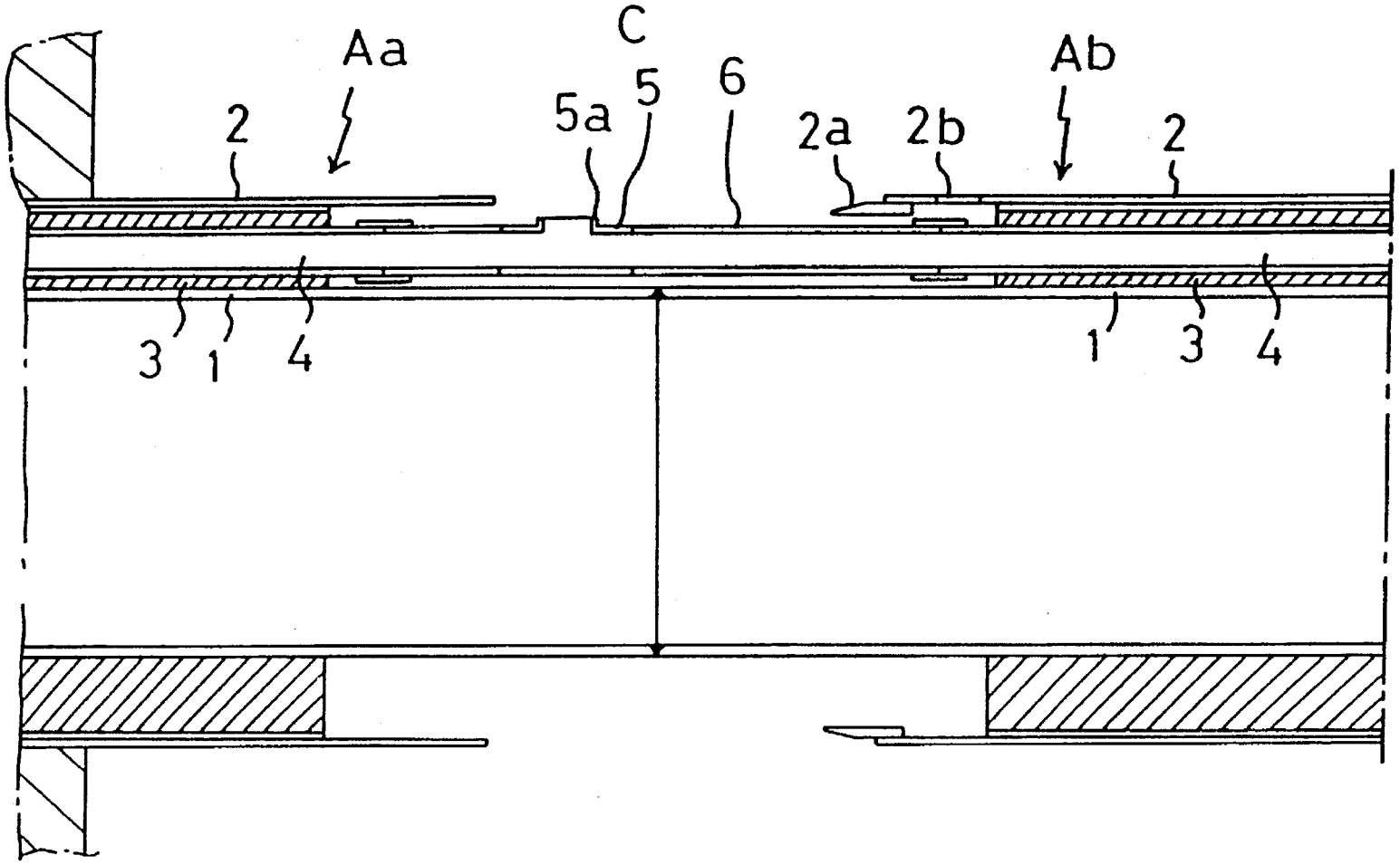
FIG. 2 is a sectional view for showing a state in which an inner pipe of the first double-wall pipe is connected with an inner pipe of the second double-wall pipe, and thereafter sheath pipes are connected with each other.

Then, as shown in FIG. 2, sheath pipes 4 are connected with each other. The connection of sheath pipes 4 is carried out by disposing a joint member 6 having T-typed joint 5 between an end of sheath pipe 4 of the first double-wall pipe Aa which has been propelled and an end of the second double-wall pipe Ab and securing an end of the joint member 6, for example, through a polyvinylchloride pipe or a flexible pipe, to an end of sheath pipe 4, wherein a branch pipe 5*a* of T-typed joint 5 is directed radially and outward.

Figure 3:
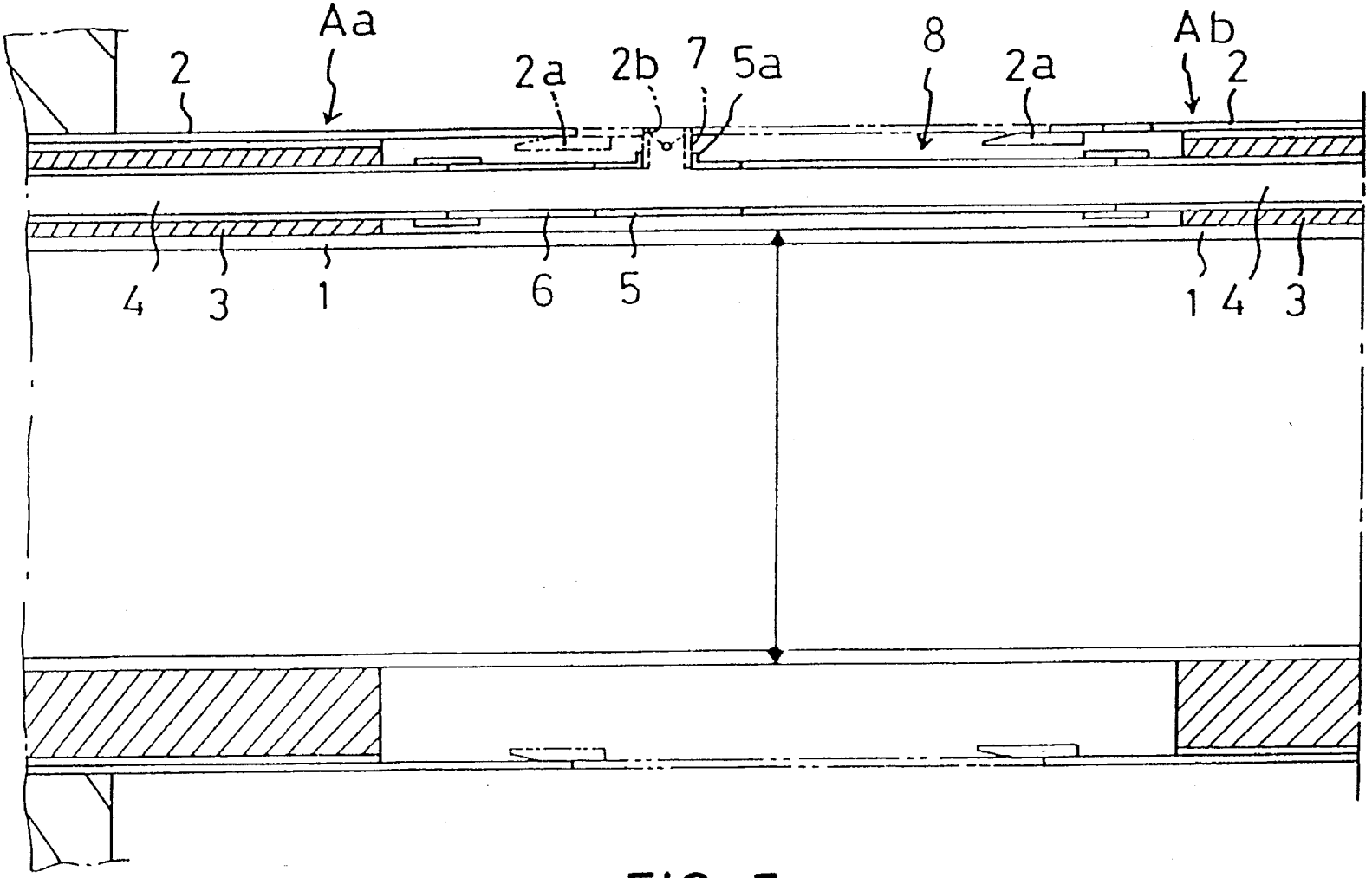
FIG. 3 is a view for showing the process in which a check valve is mounted to a T-typed joint.

Then, the outer pipe 2 of the first double-wall pipe Aa which has been propelled is connected to the outer pipe 2 of the second-double wall pipe Ab. The connection is made, as shown in FIG. 3, by applying thrust to the outer pipe 2 of the second double-wall pipe Ab by a pipe-jacking machine that the outer pipe 2 of the second double-wall pipe Ab is propelled to a position which is shown by long and two short dash lines, and at which the outer pipe 2 of the second double-wall Ab is brought into contact with the outer pipe 2 of the first double-wall pipe which has been propelled, wherein guide ring 2*a* provided at the end of the outer pipe 2 facilitates the connection of the first double-wall pipe with the second double-wall pipe.

After the outer pipe 2 of the first double-wall pipe which has been propelled is brought into contact with the outer pipe 2 of the second double-wall pipe 2, hole 2*b*, in which check valve 7 is mounted, is formed at a position which is opposed to branch pipe 5*a* of T-typed joint 5 in the end of the outer pipe 2 of the second double-wall pipe Aa. Check valve 7 makes it possible to inject lubricant or back-filling material supplied from branch pipe 5 of T-typed joint 5 into a space between the outside of outer pipes 2 and the ground, while check valve 7 prevents subterranean water or earth and sand from being flown into T-typed joint 5. Hole 2*b* is preferably formed when double-wall pipe A is manufactured.

As above-mentioned, the first double-wall pipe Aa which has been propelled is connected with the second double-wall pipe Ab so that a space 8 is formed by inner pipe 1, intermediate layer 3 and outer pipe 2.

Figure 4:
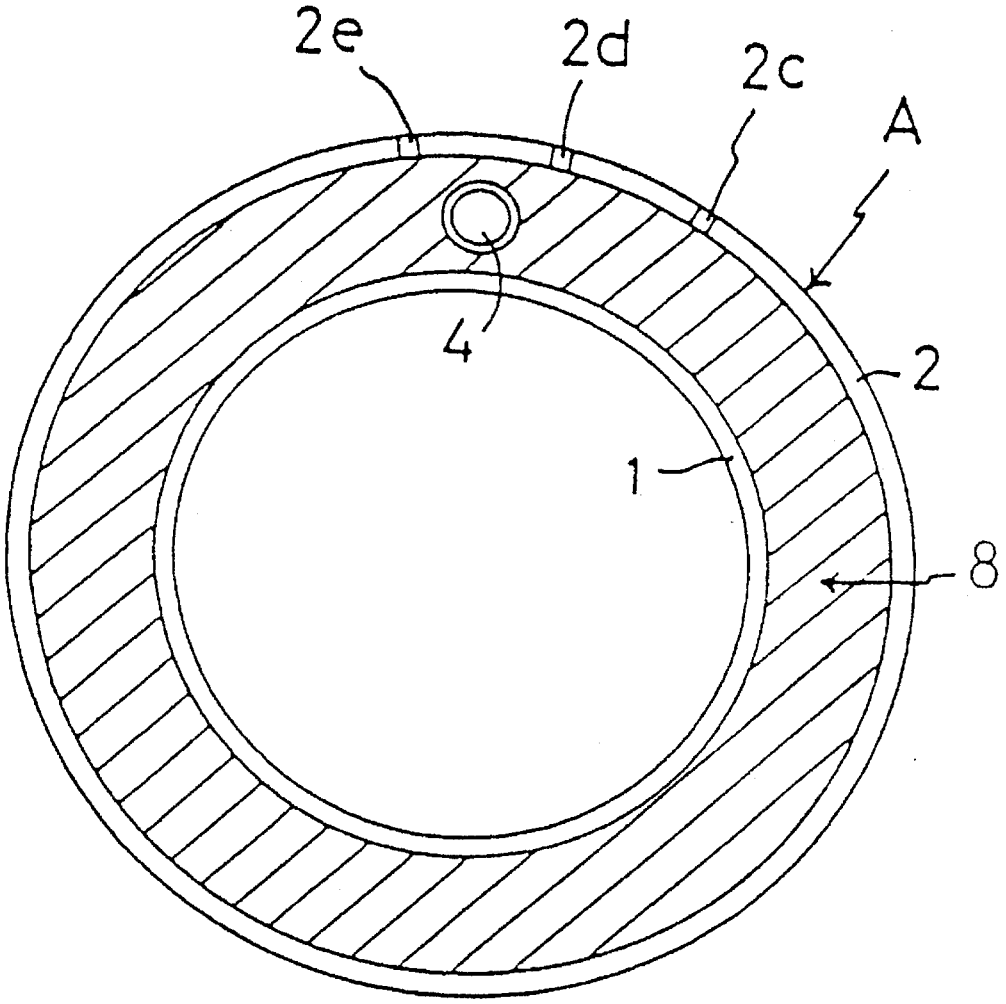
FIG. 4 is a transverse sectional view of a double-wall pipe.

The above-mentioned space 8 is a weak strength portion. Therefore, a space between inner pipe 1 and outer pipe 2 is filled with back-filling material such as cement milk by which inner pipe 1 and outer pipe 2 is held substantially together as a unit. By this operation, as shown in FIG. 4, plural holes 2*c* to 2*e* are formed at a position corresponding to the space 8 of outer pipe 2. Cement milk is injected into space 8 through hole 2*c*. Namely, when cement milk is supplied through a hose (not shown ) connected with hole 2*c* by which the space 8 between inner pipe 1 and outer pipe 2 is filled with cement milk so that the cement milk overflows holes 2*d*, 2*e*. Accordingly, the space 8 between inner pipe 1 and outer pipe 2 can be filled with cement milk as back-filling material.

Figure 5:
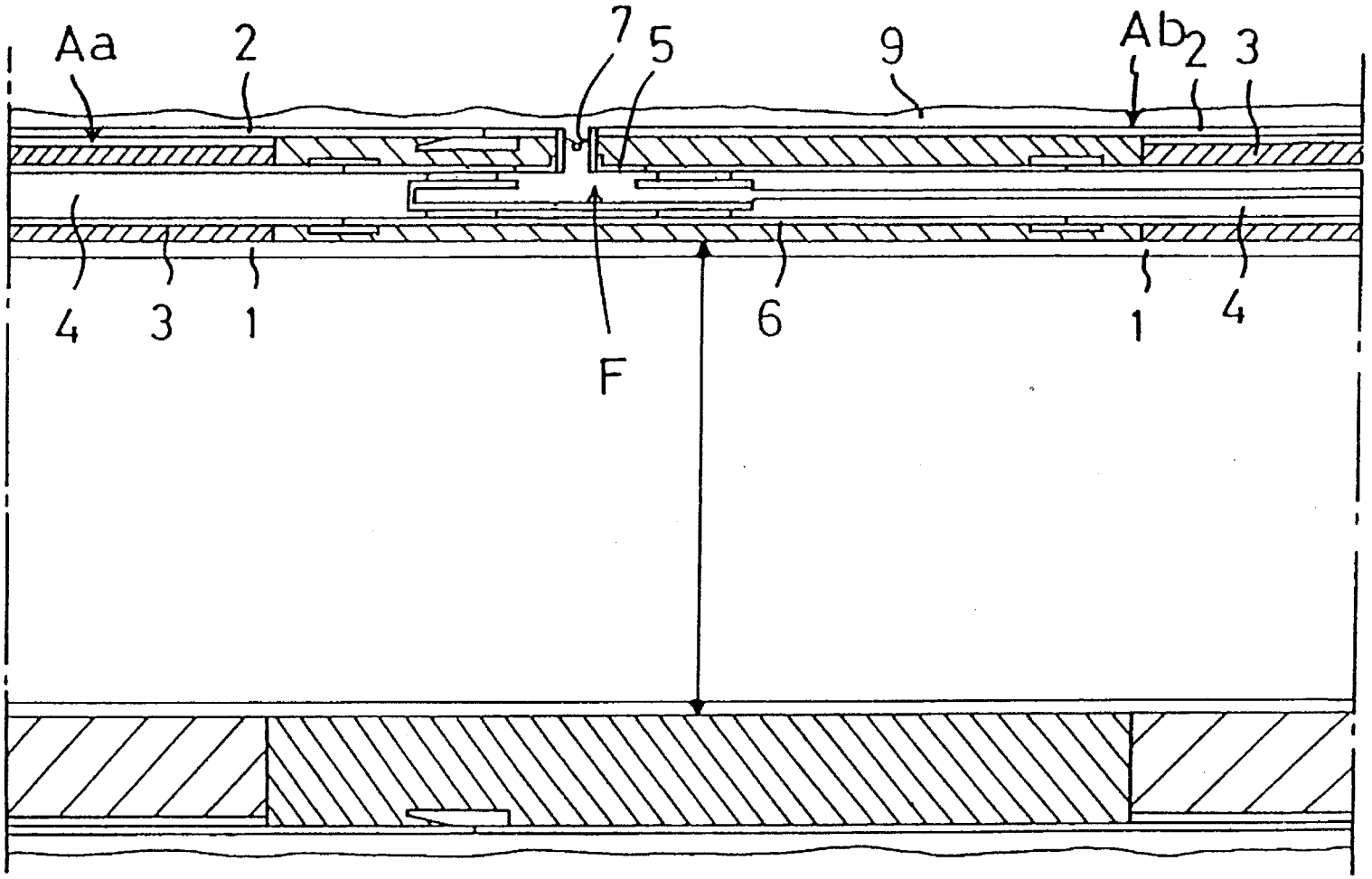
FIG. 5 is a sectional view for showing a state in which lubricant is injected into a space between the outside of an outer pipe and the ground.

As above-mentioned, after the first double-wall pipe which has been propelled is connected with the second double-wall pipe Ab, as shown in FIG. 5, lubricant injecting member F is inserted into sheath pipe 4 which is hereinafter mentioned. Then, after lubricant injecting member F is moved to a position of T-typed joint and held, lubricant is supplied through T-typed joint, branch pipe 5*a* of T-typed joint, and check-valve 7 into a space 9 formed between the outside of the outer pipe 2 and the ground, by which frictional resistance can be decreased together with the propulsion of double-wall pipe A.

Double-wall pipes A which are held as a unit are propelled by operating a pipe-jacking machine to apply thrust to outer pipes 2 of the double-wall pipes, while injecting lubricant into a space between the outside of outer pipes 2 and the ground, wherein the operation of injection of lubricant is appropriately carried out by moving injecting member F, during propelling double-wall pipes A.

Double-wall pipes A which are held by a unit are propelled to such a position that the backward end of the second double-wall pipe A protrudes into start vertical shaft C, by the above-mentioned operation, and thereafter a third double-wall pipe A is disposed in start vertical shaft, and then the above-mentioned operations are repeated, thereby a new double-wall pipe is connected with the double-wall pipes which have been propelled and the new double-wall pipe and the double-wall pipes which have been propelled are propelled. As the tunneling machine arrives in arrival vertical shaft D, a conduit B composed of double-wall pipes A is laid between start vertical shaft C and arrival vertical shaft D.

Figure 6:
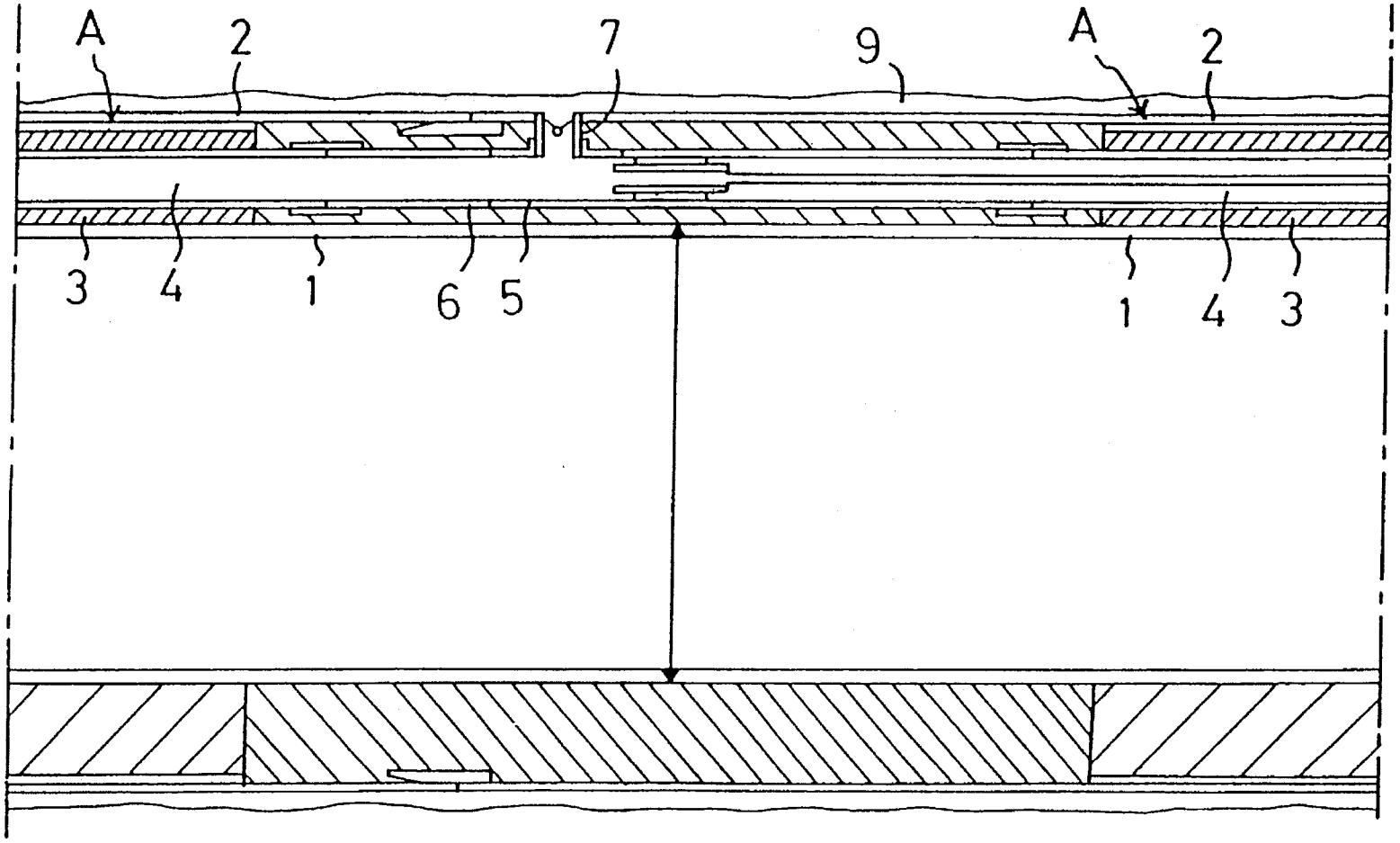
FIG. 6 is a sectional view for showing a state in which back-filling material is injected into a space between the outside of an outer pipe and the ground.

After conduit B has been laid, as shown in FIG. 6, in order to inject back-filling material into space 9 between the outside of outer pipes 2 and the ground, a back-filling material injecting member which has an opening is inserted into sheath pipe 4, and cement milk is sent through the back-filling material injecting member to the inside of sheath pipe 4, while space 9 between the outside of outer pipes 2 and the ground through branch pipe 5*a*, and check valve 7. The injection of back-filling material may be carried out by means of lubricant injecting member F.

Then, another method of injecting lubricant or back-filling material into space 9 between the outside of outer pipes 2 and the ground is mentioned.

Figure 7:
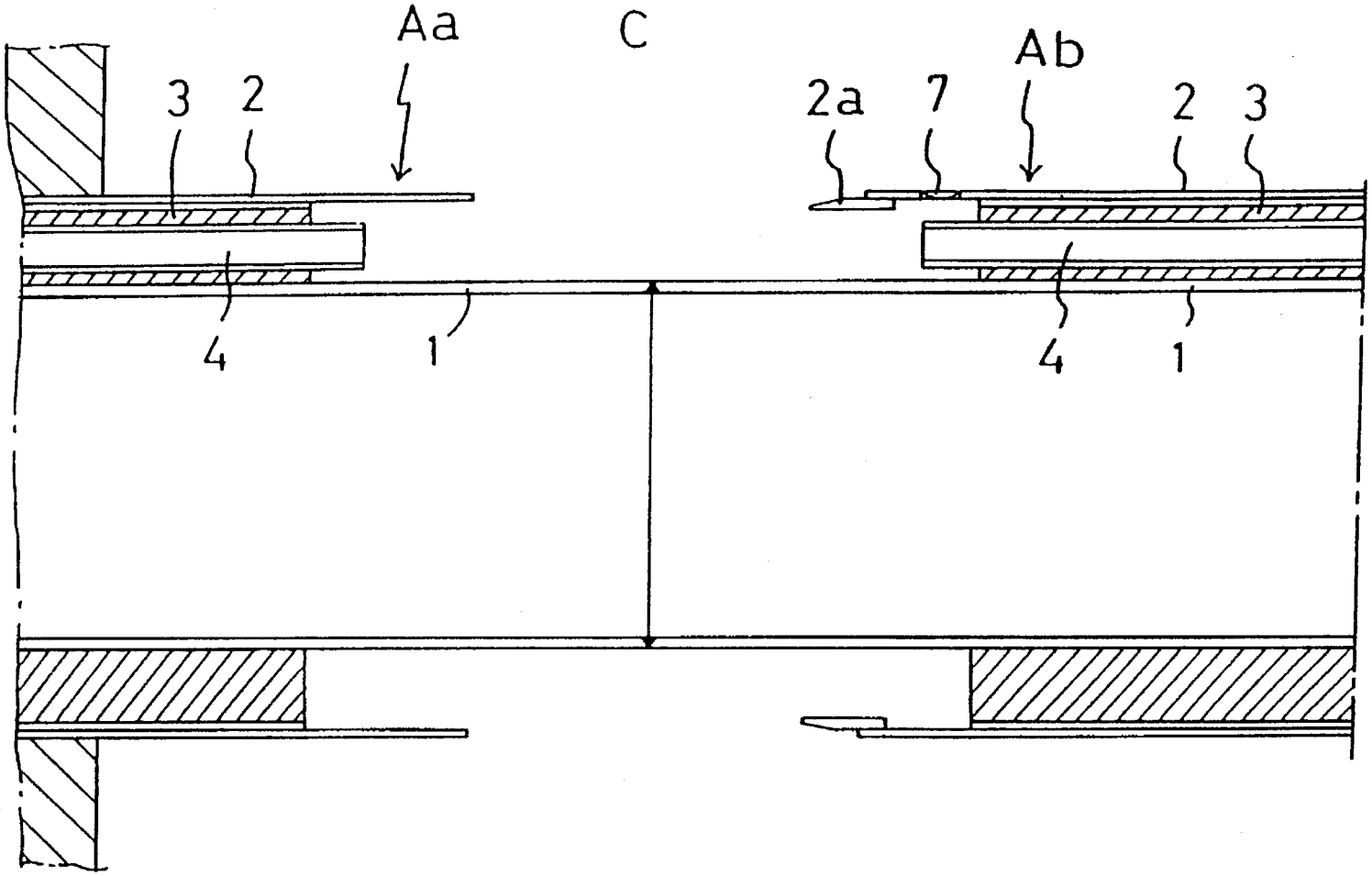
FIG. 7 is a sectional view for showing a state in which inner pipes are connected with each other, and thereafter sheath pipes are connected with each other.

In the present embodiment, in the same way as the above-mentioned embodiment, the backward end of a first double-wall pipes which has been propelled, wherein the backward end protrudes into start vertical shaft C, is connected with a second double-wall pipe Ab(shown in FIG. 7). In this time, check valve 7 is mounted in the second double-wall pipe Ab in advance.

Under the condition that the inner pipe 1 of the first double-wall pipe Aa which has propelled is connected with the inner pipe 1 of the second double-wall pipe Ab, there is the large interval between ends of sheath pipes 4 provided in intermediate layer 3. When injecting lubricant or back-filling material into space 9 between the outside of outer pipes 2 and the ground, the interval between ends of sheath pipes 4 is not a serious problem. However, in order to insert injecting member F for lubricant or back-filling material into sheath pipes 4, the distance between ends of sheath pipes 4 is preferably small.

Figure 8:
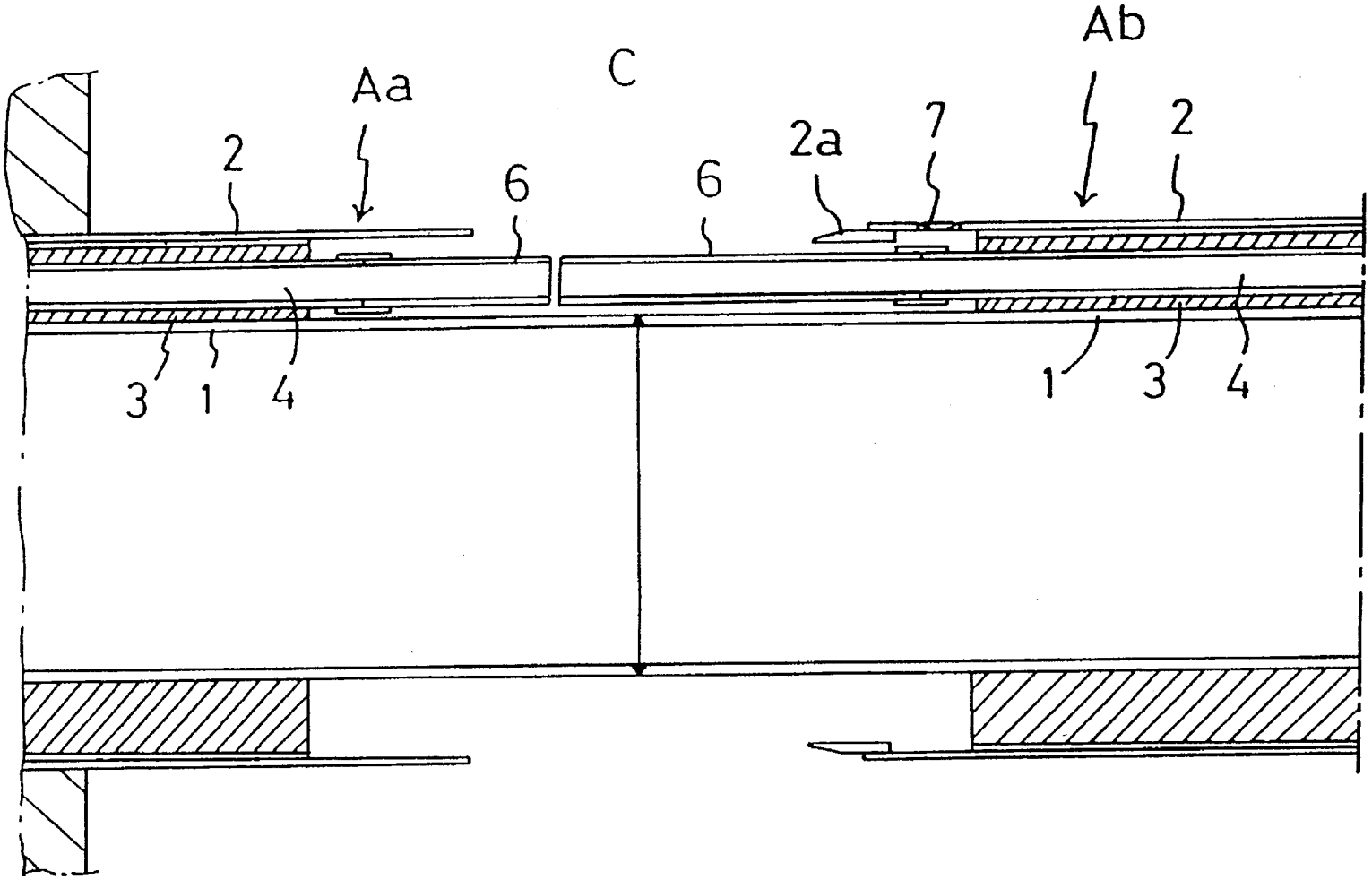
FIG. 8 is a sectional view for showing a state in which sheath pipes are connected with each other.
Figure 9:
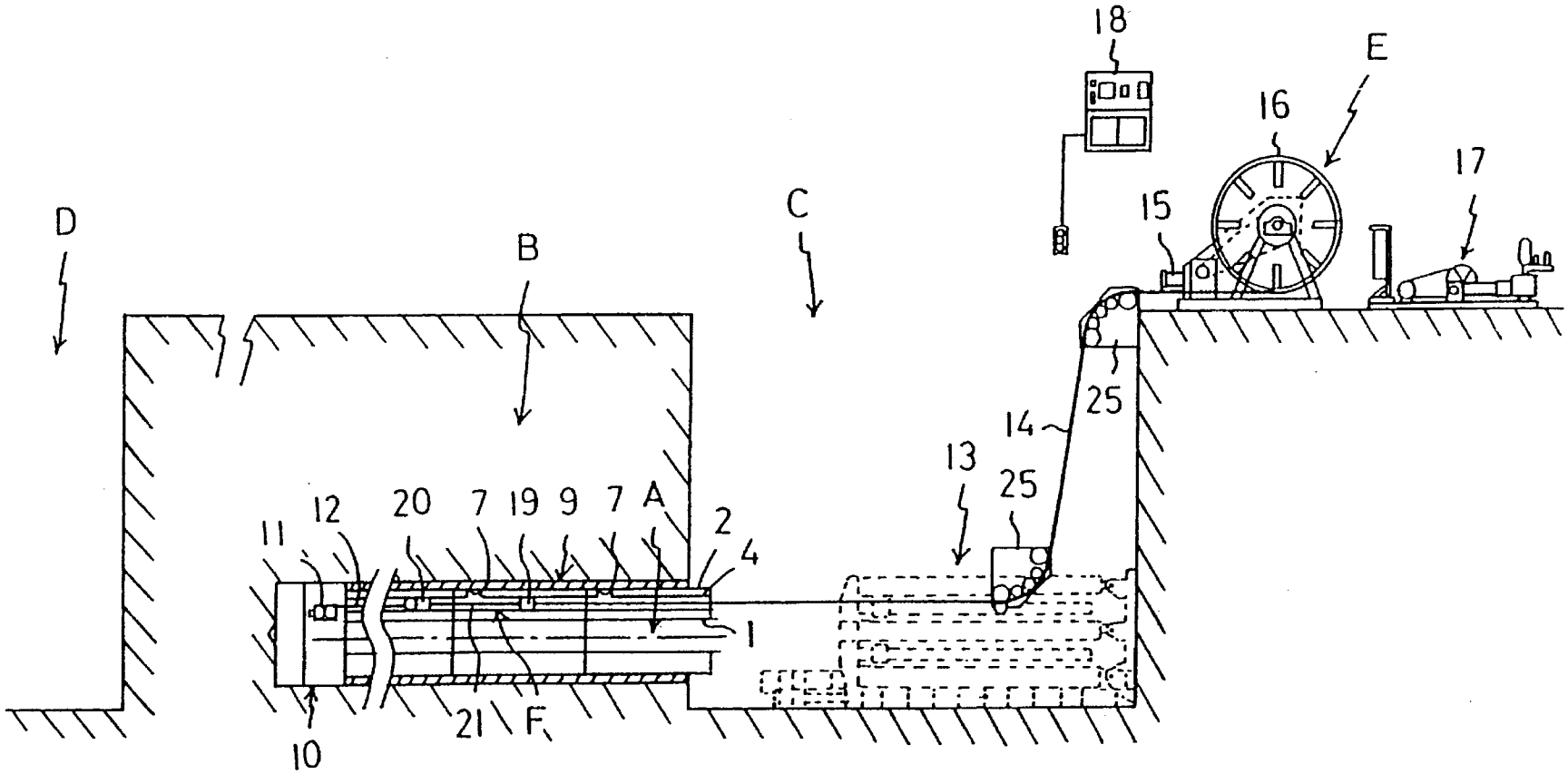
FIG. 9 is a view for illustrating a state where lubricant is injected into a space between double-wall pipes which are propelling and the ground.
Figure 10:
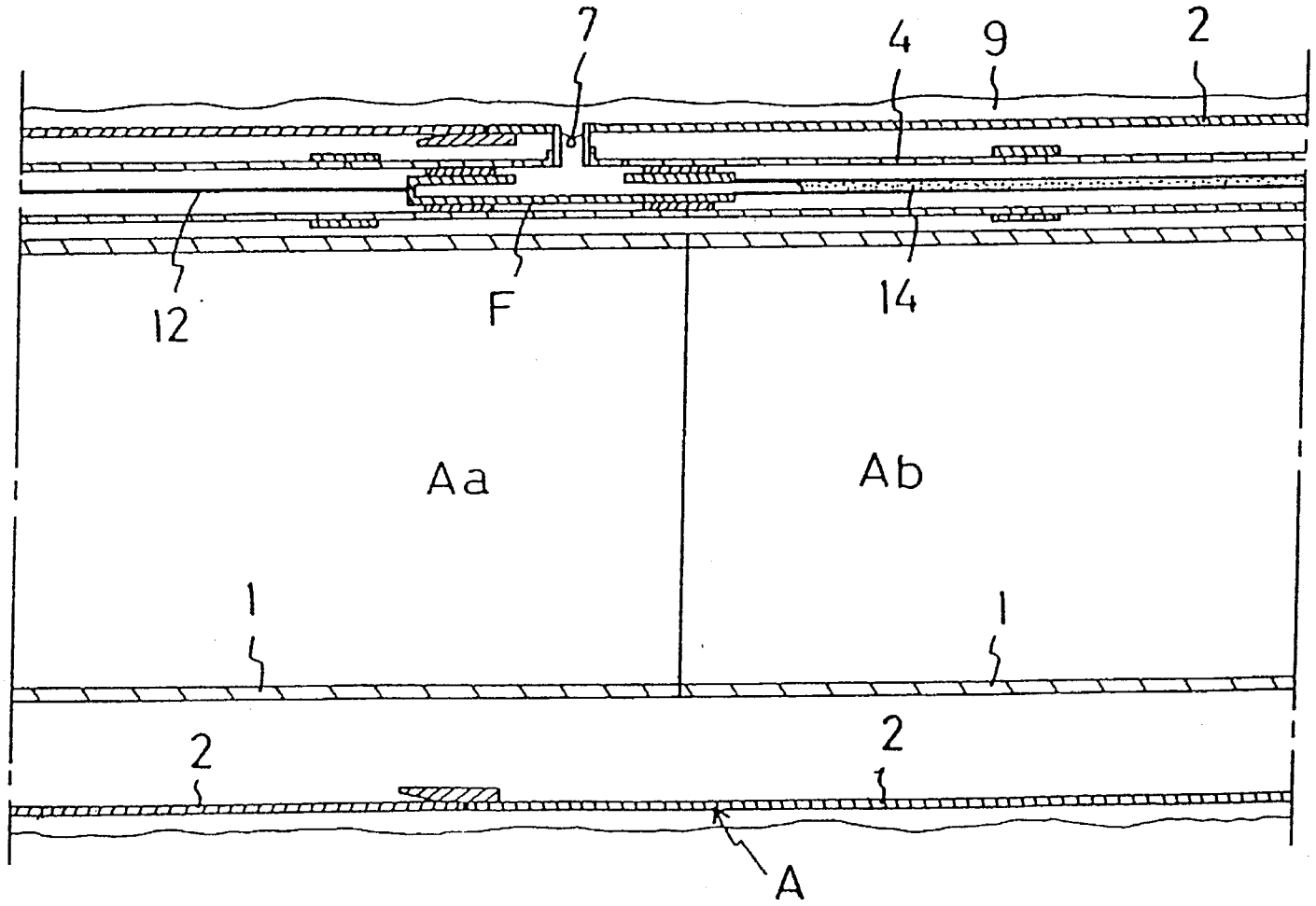
FIG. 10 is a view for illustrating the structure of double-wall pipes and a state where lubricant or back-filling material is injected into a space between double-wall pipes and the ground.
Figure 11:
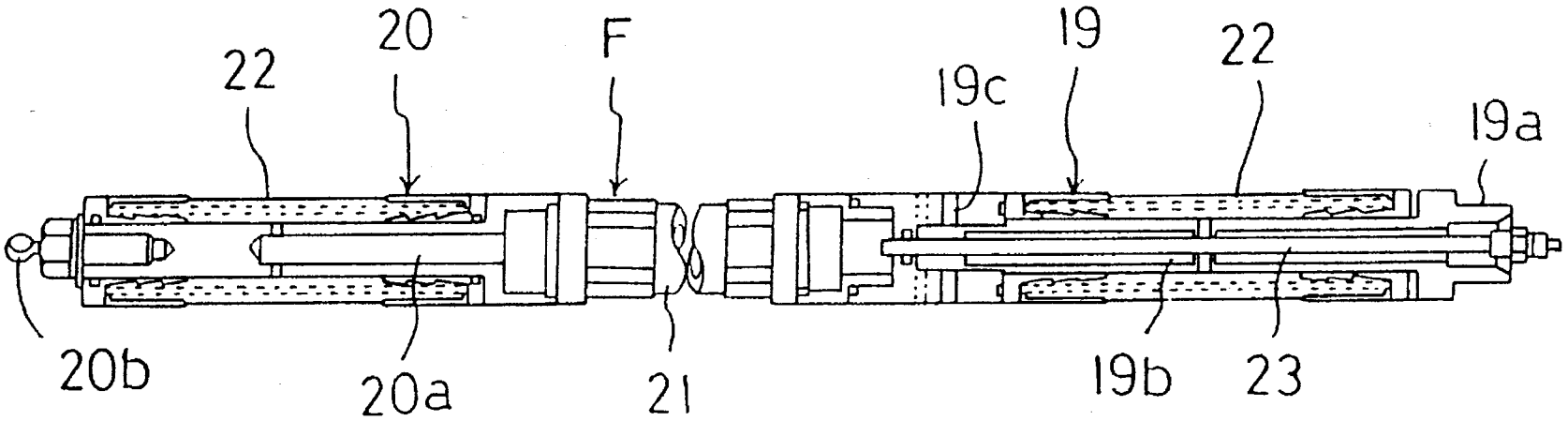
FIG. 11 is a view for illustrating the structure of an injecting material.
Figure 12:
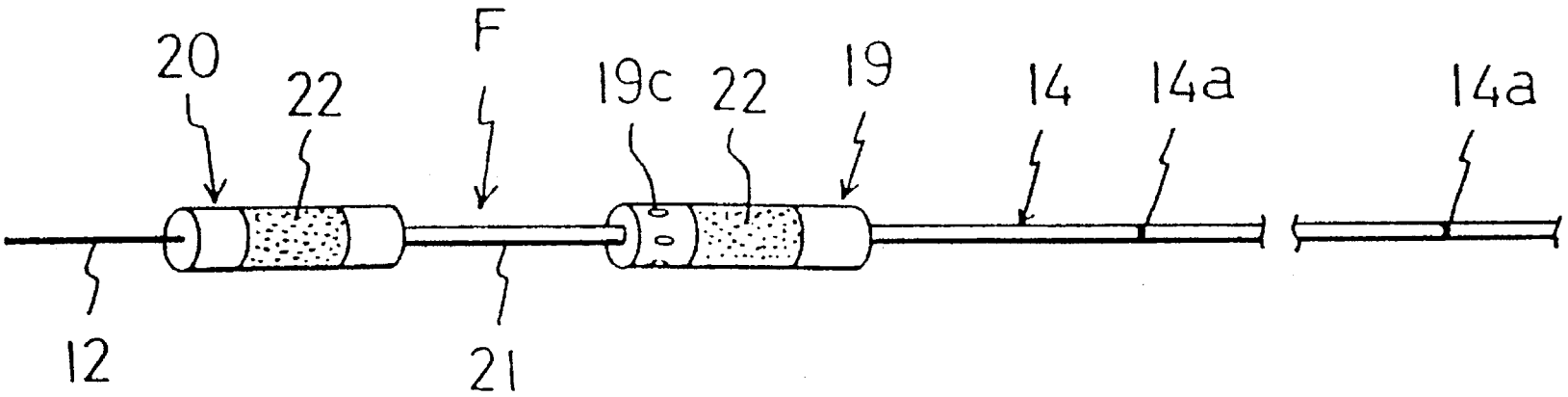
FIG. 12 is a view for illustrating an lubricant supply pipe or a back-filling material supply pipe which is marked with degrees.
Figure 13:
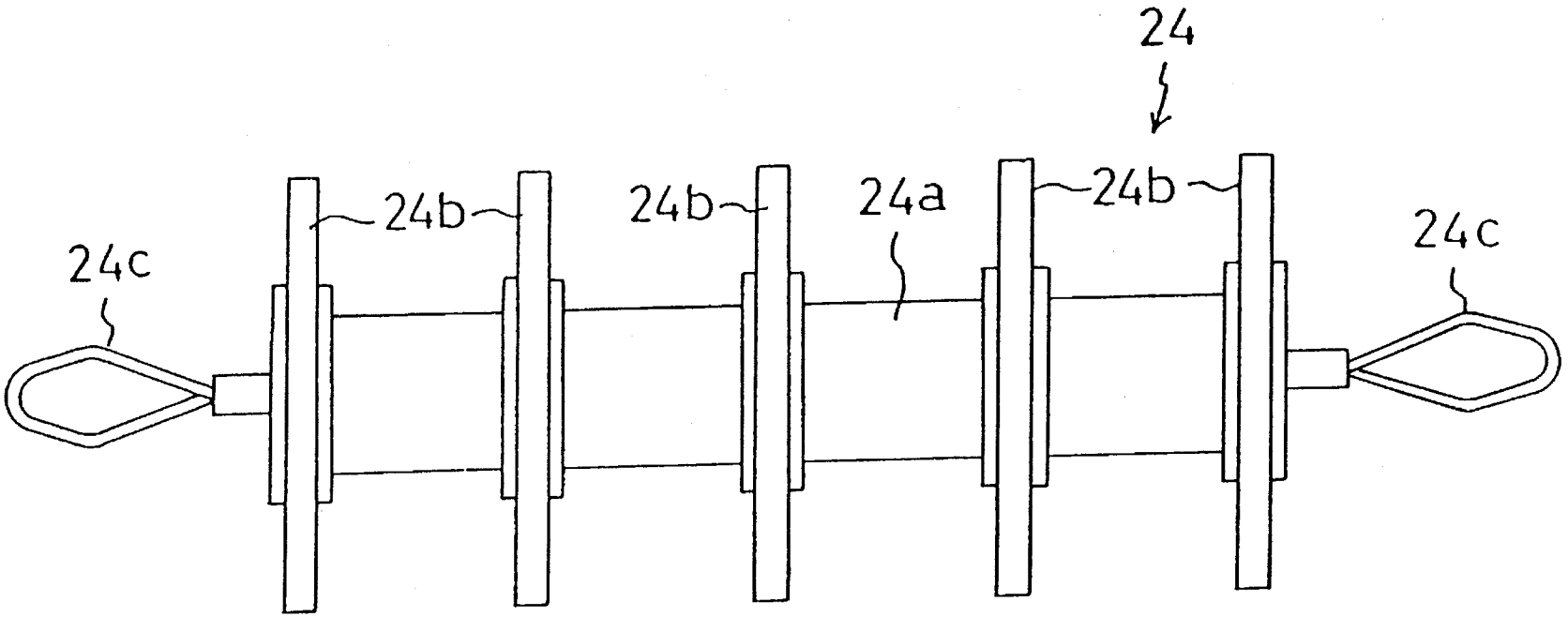
FIG. 13 is a view for illustrating the structure of a cleaning member.

Accordingly, as shown in FIG. 8, sheath pipes 4 approach each other by tubular joint member 6 connected with the second double-wall pipe Ab through a short pipe, flexible tube and others.

After inner pipes 1 are connected with each other, the outer pipe 2 of the second double-wall pipe Aa is brought into contact with the outer pipe 2 of the first double-wall pipe Ab by applying thrust to the outer pipe 2 of the second double-wall pipe Ab so that space 8 bounded by inner pipe 1, outer pipe 2 and intermediate layer 3, in such a manner as the above-mentioned embodiment, in which end portions of sheath pipes 4 and check valve 7 are disposed.

Accordingly, lubricant, which is supplied in injecting member F inserted into sheath pipe 4 while double-wall pipes are propelled, is injected into space 8 bounded by inner pipe 1, outer pipe 2 and intermediate layer 3 through the opening of the sheath pipe 4 of the second double-wall pipe 4. Lubricant which overflows the space 8 is injected into space 9 formed between the outside of outer pipe 2 and the ground through check valve 7 so that frictional force between double-wall pipes A and the ground while double-wall pipes being propelled can be decreased.

Further, after conduit B composed of double-wall pipes A has been laid, back-filling material is supplied through injecting member F inserted into sheath pipe 4 into the space 8, while lubricant packed in the space 8 is passed out through check valve 7, by which lubricant packed in the space 8 is replaced with back-filling material. Further, back-filling material which overflows the space 8 is injected into space 9 between the outside of outer pipes 2 and the ground so that the space 9 is filled with back-filling material.

As above-mentioned, conduit B and the ground can be held as a unit by smoothly propelling double-wall pipes A while injecting lubricant into space 9 between the ground of double-wall pipes and the ground, and thereafter injecting back-filling material into the space 9.

Then, a method of easily injecting lubricant or back-filling material into space 9 between the outside of double-wall pipes A and the ground and an apparatus therefor are explained with reference to FIGS. 9 to 13. In the present embodiment, an operation for inserting injecting member F into sheath pipe 4 at the time when lubricant or back-filling material is injected into space 9 between double-wall pipes A and the ground.

In the present embodiment, at the time when lubricant is injected into space 9 between the outside of double-wall pipes A and the ground or when back-filling material is injected into space 9 between the outside of double-wall pipes and the ground, procedures of inserting lubricant supply pipe or back-filling material supply pipe are the same. Therefore, in the case where lubricant is injected into space 9 between the outside of the outer pipe and the ground is representatively explained.

Winch 11 is mounted in the inside of tunneling machine 10 positioned at the head. As tunneling machine 10, a known tunneling machine which can carry out a semi-shield method is used. Wire 12 which has the length longer than the full laying length of double-wall pipes A preset (the full length of conduit B) is wound round winch 11. Tunneling machine 10 and double-wall pipes A can be propelled by excavating the ground by the tunneling machine, while propelling double-wall pipes by pipe-jacking machine 13.

Winch 11 is driven in such a direction that wire 12 is wound. While wire 12 is unwound, wire 12 is tensed so that winch 11 is reversed. Tunneling machine 10 is provided with winches 7 by a number corresponding to the number of sheath pipes 4.

Supply pipe 14 for lubricant is made of flexible material. Supply pipe 14 is wound on drum 16 which is driven by drive 15. An end of supply pipe 14 is connected with pump 17 for forcing lubricant. Pump 17 is connected with a tank ( not shown ) containing lubricant. Numeral 18 designates a control panel for controlling drive 15, drum 16 and pump 17. Lubricant feeder E comprises drive 15, drum 16, pump 17, a tank and others.

Injecting member F is connected with the other end of supply pipe 11. Injecting member F has two packing means 16, 17 disposed at a given interval, which are connected with hose 18. An interval between packing means 16, 17 is preferably larger than the size of a space where check valve 4 is disposed.

Packing means 19, 20 have rubber tubes 22, respectively. Filling member F connected with the other end of supply pipe 14 is moved into sheath pipe 3 so that injecting members F are positioned at a distance from each other and at the desired relative positions to sheath pipe 3, thereafter compressed gas is supplied into rubber tubes 22 to inflate rubber tube 22 so that rubber tube 22 is brought closely into contact with the inside of sheath pipe 4 by which injecting member F is fixed to sheath pipe 4 and an airtight space between packing means 16, 17 is formed.

Packing means 19 is provided with nipple 19*a* one end of which is connected with supply pipe 14. A gas pipe 23 through which compressed gas as compressed air or nitrogen gas is passed is provided in packing means 19, and a path 19*c* for flowing lubricant is formed between the inside of packing means 19 and gas pipe 23. Packing means 19 is formed at the other end thereof with outlet 19*c* through which lubricant is injected into sheath pipe 4. The other end of gay pipe 23 opens within hose 21 so that compressed gas passed through gas pipe 23 is supplied through to packing means 20.

Packing means 20 has therein path 20*a* into which compressed gas is passed so that rubber tube 22 is inflated by compressed gas. Packing means 20 is provided at the forward end thereof with hook 20*b* to which wire 12 wound on winch 11 or hereinafter-mentioned cleaning member 24 is connected.

Supply pipe 14 has marks 14*a* at regular intervals, for example at intervals corresponding to unit length of a double-wall pipe A or the length of plurality of double-wall pipes A. Therefore, when injecting member F and supply pipe 14 are moved in sheath pipe 4, a relative position of injecting member F to sheath pipe 4 can be determined by checking marks 14*a*.

Cleaning member 24 is provided at the forward end of injecting member F to clean the inside of sheath pipe 4. Cleaning member 24 facilitates the travel of injecting member F and supply pipe 14 by removing foreign material as lubricant or others which stay in sheath pipe 4.

Cleaning member 24 comprises shaft 24*a* and a plurality of cleaning plates 24*b* arranged on shaft 24*a* at given intervals. Each cleaning plate 24*b* has the shape which nearly equals to that of cross section of within sheath pipe 4. Particularly when cleaning plate 24*b* is made of a rubber plate having the suitable flexibility and rigidity, the outside of cleaning plate 24*b* is brought into contact with the inside of sheath pipe 4 so that the inside of sheath pipe 4 can be surely cleaned. Further, cleaning member 24 is provided at both sides thereof with connecting portion 24*c* for connecting cleaning member 24 with injecting member F and wire 12, respectively.

Then, a procedure for injecting lubricant into space 9 formed between double-wall pipes A and the ground while propelling double-wall pipes A is explained.

Prior to propelling double-wall pipes A, tunneling machine 10 is propelled. The propulsion is carried out by propelling tunneling machine 10 with pipe-jacking machine 13, while driving cutter mounted on the top face of tunneling machine 10. After tunneling machine 10 has been propelled, a first double-wall pipe A to be arranged at the head of conduit B, that is double-wall pipe A to be positioned next to arrival vertical shaft D is disposed between tunneling machine 10 and pipe-jacking machine 13.

Thereafter, wire 12 is unwound from winch 11 mounted on tunneling machine 10 by human strength, wire 12 is passed through the inside of tunneling machine 10 and the inside of sheath pipe 4 provided in double-wall pipes A, drawn out from tunneling machine 10 toward pipe-jacking machine 13, and is connected with connecting portion 24*c* of connecting member 21, thereby wire 8 is connected with cleaning member 24, injecting member F, and supply pipe 14 by which the preparation for propelling double-wall pipe A disposed on pipe-jacking machine 13 is finished.

Then, pipe-jacking machine 13 is driven so that tunneling machine 10 and double-wall pipe A are propelled with pipe-jacking machine 13, while the cutter of tunneling machine 13 is driven.

While propelling tunneling machine 10 and double-wall pipes A, winch 11 is driven so that wire 12 is wound on winch 11, thereby supply pipe 14 is unwound from drum 16 so that supply pipe 14, injecting member F, and cleaning member 24 are moved into sheath pipe 4. During this travel, the inside of sheath pipe 4 is cleaned by means of cleaning member 24.

The position of injecting member F is detected by reading mark 14*a* put on supply pipe 14. When packing means 19, 20 of injecting member F reach a position at which check valve 7 of double-wall pipe A is positioned between packing means 19, 20, winch 11 is stopped, compressed gas is supplied to packing means 19, 20 so that tubes 22 are inflated, while lubricant is forced by pump 17. Lubricant fed through supply pipe 14 is sent into a space within sheath pipe 4 sealed by packing means 19, 20 through outlet 19*c* formed in packing means 19, and injected into space 9 formed between double-wall pipes A and the ground.

When the propulsion of double-wall pipes A has been finished, pump 17 is stopped, while compressed gas supplied to packing means 19, 20 is discharged from packing means 19, 20 so that tubes 22 are deflated. Thereafter, pipe-jacking machine 13 is returned to the initial condition, and thereafter drum 16 is driven so that wire 12 with supply pipe 14, injecting member F, wire 12 is drawn out through sheath pipe 4 toward start vertical shaft C. After wire 12 has been drawn out toward start vertical shaft C, wire 12 is disconnected from cleaning member 24.

Second double-wall pipe A is disposed on pipe-jacking machine 18, wire 12 is passed through sheath pipe 4 provided in double-wall pipes A, and connected with cleaning member 24. Thereafter, the same operation as the above-mentioned operation is repeated by which double-wall pipes A can be propelled from start vertical shaft C toward arrival vertical shaft D, while lubricant is injected into space 9 formed between double-wall pipes A and the ground.

When cleaning member 24, injecting member F, and supply pipe 14 are moved in sheath pipe 4, cleaning plates 24*b* forming cleaning member 24, a part of injecting member F, and supply pipe 14 are brought into contact with the inside of sheath pipe 4. Therefore, a resistance force caused by the friction of cleaning plates 24*b*, a part of injecting member F, and supply pipe 14 with the inside of sheath pipe 4, and a force needed for drawing supply pipe 11 are applied on winch 11 and drive 15 of drum 16. This load is increased as the laying length of double-wall pipes A increases. Therefore, there is a problem in that it is necessary to increase outputs of winch 11, drive 15 of drum 15 or to thicken wire 12. Further, there is a problem that supply pipe 14 stretches.

In order to solve the above-mentioned problem, cleaning member 24, according to the present invention, injecting member F, and supply pipe 14 are moved in sheath 4, while lubricant is intermittently discharged from injecting member F. Namely, when lubricant is supplied through injecting member F without inflating packing means 19, 20 of injecting member F, the lubricant is discharged from outlet 19*c* of packing means 19 into the inside of sheath pipe 4.

When injecting member F is moved toward start vertical shaft C, lubricant which is injected into sheath pipe 4 remains within sheath pipe 4, a portion of supply pipe 14 which comes into contact with sheath pipe 4 is lubricated with lubricant which has remained so that a frictional force between supply pipe 14 and sheath pipe 4 can be reduced.

When injecting member F is moved toward start vertical shaft C, lubricant which has been discharged and remained in sheath pipe 4 is scratched by cleaning plate 24*b*, wherein contact resistance between cleaning plate 24*b* and sheath pipe 4 can be reduced.

Further, packing means 19, 20 forming injecting member F can be mounted at the same intervals as the length of double-wall pipe A, or at the same intervals as the length of a plurality of double-well pipes A. Thereby, even if supply pipe 14 has any elongation, the position of injecting member F in sheath pipe 4 can be easily established so that check valve 7 of double-wall pipe A can be positioned between packing means 19, 20.

Prior to supplying lubricant into double-wall pipes A while being propelled, operations such as moving injecting members F in sheath pipe 4 and supply pipe 14, and connecting double-wall pipe A which has been propelled with a new double-wall pipe A are frequently carried out. Therefore, it is preferable that guide unit 25 is mounted at start vertical shaft C, which makes it easy to move supply pipe 14.

As above-mentioned, conduit B comprised of double-wall pipes A is laid between start vertical shaft C and arrival vertical shaft D, and thereafter back-filling material can be injected, while the connection of tunneling machine 10 with first double-wall pipe A which is the component of conduit B is maintained.

As above-mentioned, injection of back-filling material can be carried out by carrying out the same operation as the injection of lubricant: pump 17 connected with a tank in which back-filling material is placed is connected with supply pipe 14 provided with injecting member F. At this time, a pump and a supply pipe for exclusive use for back-filling material may be used as pump 17 and supply pipe 14. However, they have the same structure as that of a pump and a supply pipe 11 for lubricant. Further, cleaning member 21 is not necessary needed.

Injecting member F and supply pipe 14 are moved through sheath pipe 4 provided in double-wall pipes A forming conduit B which has been laid, to the double-wall pipe A which is in the forefront, and thereafter pump 17 is driven by which back-filling material is injected through check valve 7 into the space 9 between the outside of the double-wall pipe A which is in the forefront and the ground. Further, while supply pipe 14 is pulled back toward start vertical shaft C, back-filling material is injected into space 7 between the outside of double-wall pipe A and the ground, at positions where the supply pipe 14 is opposed to each check valve 7 in order. When the injection of back-filling material into space 9 formed between double-wall pipe A near to start vertical shaft A and the ground through check valve 7 provided in the double-wall pipe A near to start vertical shaft A is finished, the filling of space 9 formed between conduit B and the ground with back-filling material is finished.

Then, another embodiment of a method of injecting back-filling material into space 9 formed between conduit B laid between start vertical shaft C and arrival vertical shaft D and the ground is explained referring to FIGS. 14 to 19, wherein like reference characters designate like or corresponding parts throughout, about which explanation is omitted.

After conduit B has been laid between start vertical shaft C and arrival vertical shaft D, a tunneling machine is separated from the double-wall pipe A which is in the forefront and taken out of arrival vertical shaft D.

Figure 14:
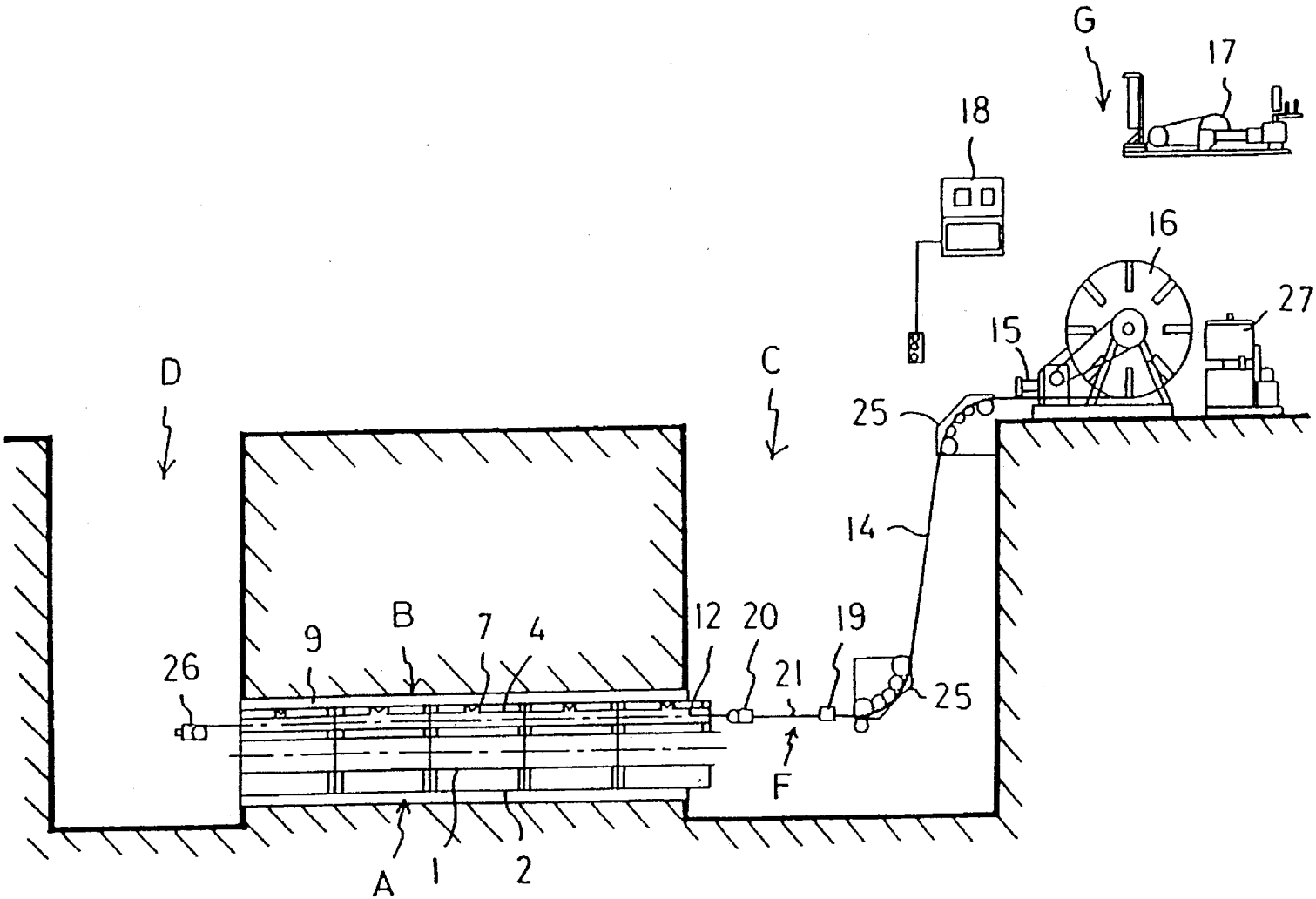
FIG. 14 is a view for illustrating the steps of injecting back-filling material into a space between the conduit which has been laid and the ground, wherein an initial preparatory step is shown.

As shown in FIG. 14, winch 26 on which wire 12 inserted into sheath pipes 4 provided in double-wall pipes A is wound is mounted in arrival vertical shaft D, and back-filling material feeder G is mounted. Back-filling material feeder G comprises mixer 27 and pump 17. Back-filling material is mixed in mixer 27 and forced by pump 14 to be sent through supply pipe 11 into a space formed between conduit B and the ground.

Wire 12 unwound from winch 26 is sent through the inside of sheath pipes 3 toward start vertical shaft C, and connected with injecting member F provided in supply pipe 14.

Figure 15:
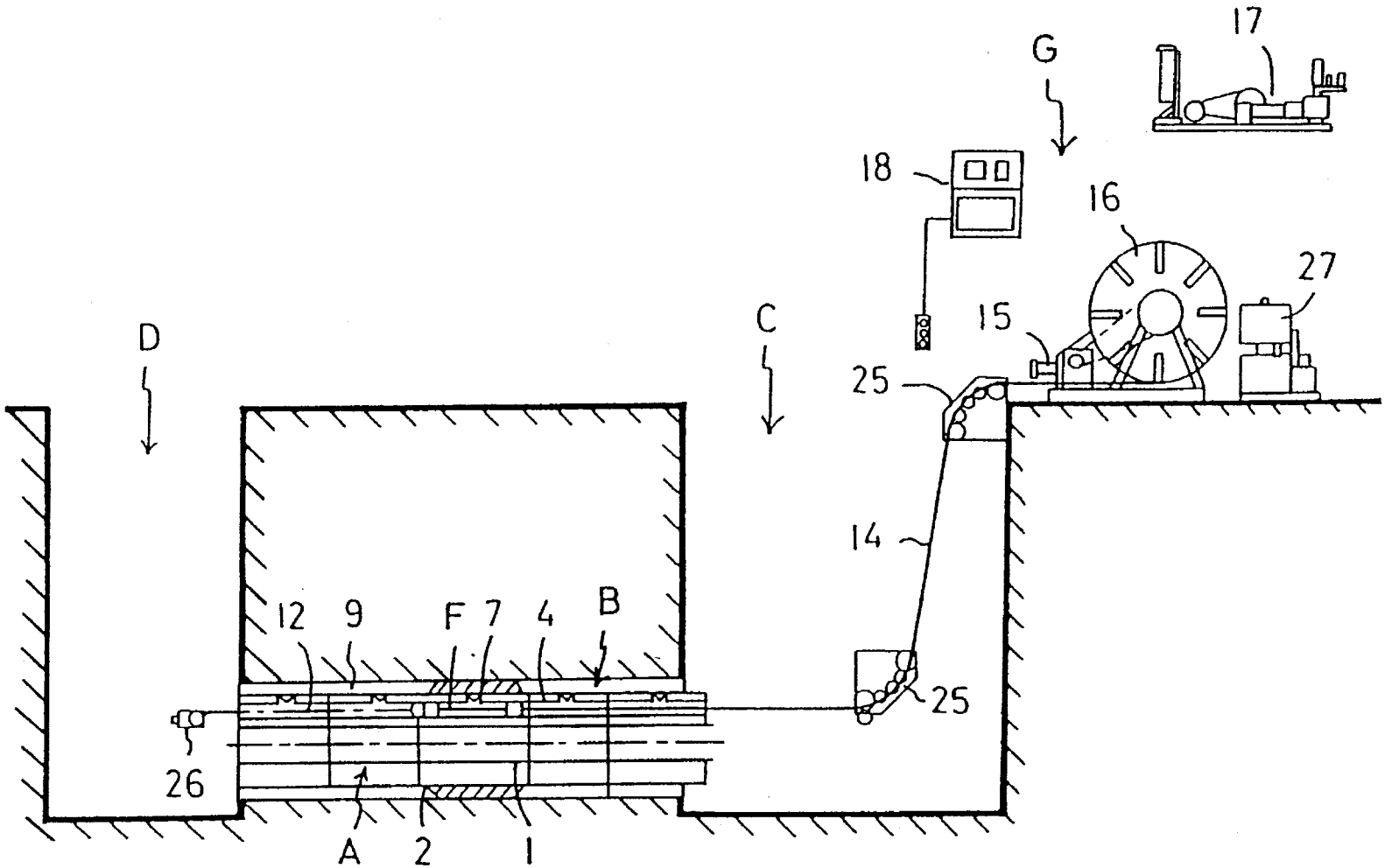
FIG. 15 is a view for illustrating a state where injection of back-filling material into a space between the conduit and the ground is started.

Then, as shown in FIG. 15, wire 12 is wound on winch 26 by driving winch 26 so that injecting member F and supply pipe 14 are moved into sheath pipe 4 to such a position that injecting member F is opposed to a check valve 7 positioned nearly in the center of conduit B. When injecting member F is sent at such a position that injecting member F is opposed to the given check valve 7, packing means 19, 20 are inflated so that the inside of sheath pipe 3 between packing means 19, 20 is sealed, and thereafter back-filling material is supplied through supply pipe 14 into the inside of sheath pipe 4 from injecting member F. Back-filling material supplied from back-filling material feeder G is discharged from injecting member F, and injected through check valve 7 into space 9 formed between outer pipe 2 of double-wall pipe A and the ground. When injecting amount of back-filling material reaches the given amount, pump 14 is stopped.

Figure 16:
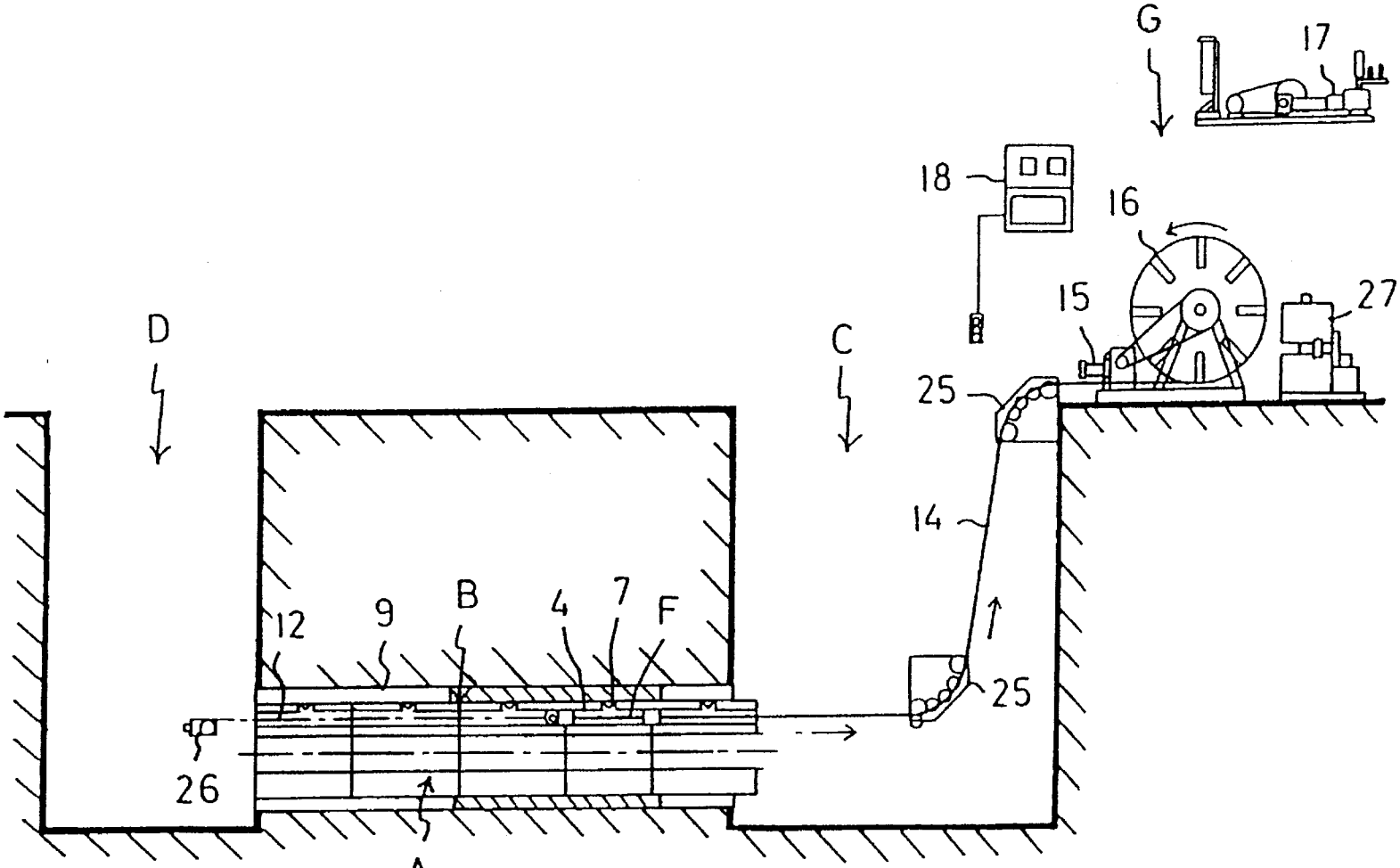
FIG. 16 is a view for illustrating a state where back-filling material is injected into a space between the conduit and the ground while a back-filling material supply pipe is drawn back.

Then, as shown in FIG. 16, injecting member F is moved back toward start vertical shaft C by winding supply pipe 14 on drum 16 by driving drum 16 by which injecting member F is opposed to check valve 7 provided in a double-wall pipe A near to start vertical shaft C side of double-wall pipe A wherein a space between the outside of the double-wall pipe A and the ground has been filled with back-filling material, and back-filling material is injected into space 9 between conduit B and the ground by carrying out the same operation as the above-mentioned operation.

Then, in the same manner, back-filling material is injected into space 9 between the outer pipes 2 of double-wall pipes A arranged on start vertical shaft C side and the ground. Thereby, back-filling material can be injected into the space 9 between a portion of conduit B having approximately half the length of the full length thereof and the ground.

Figure 17:
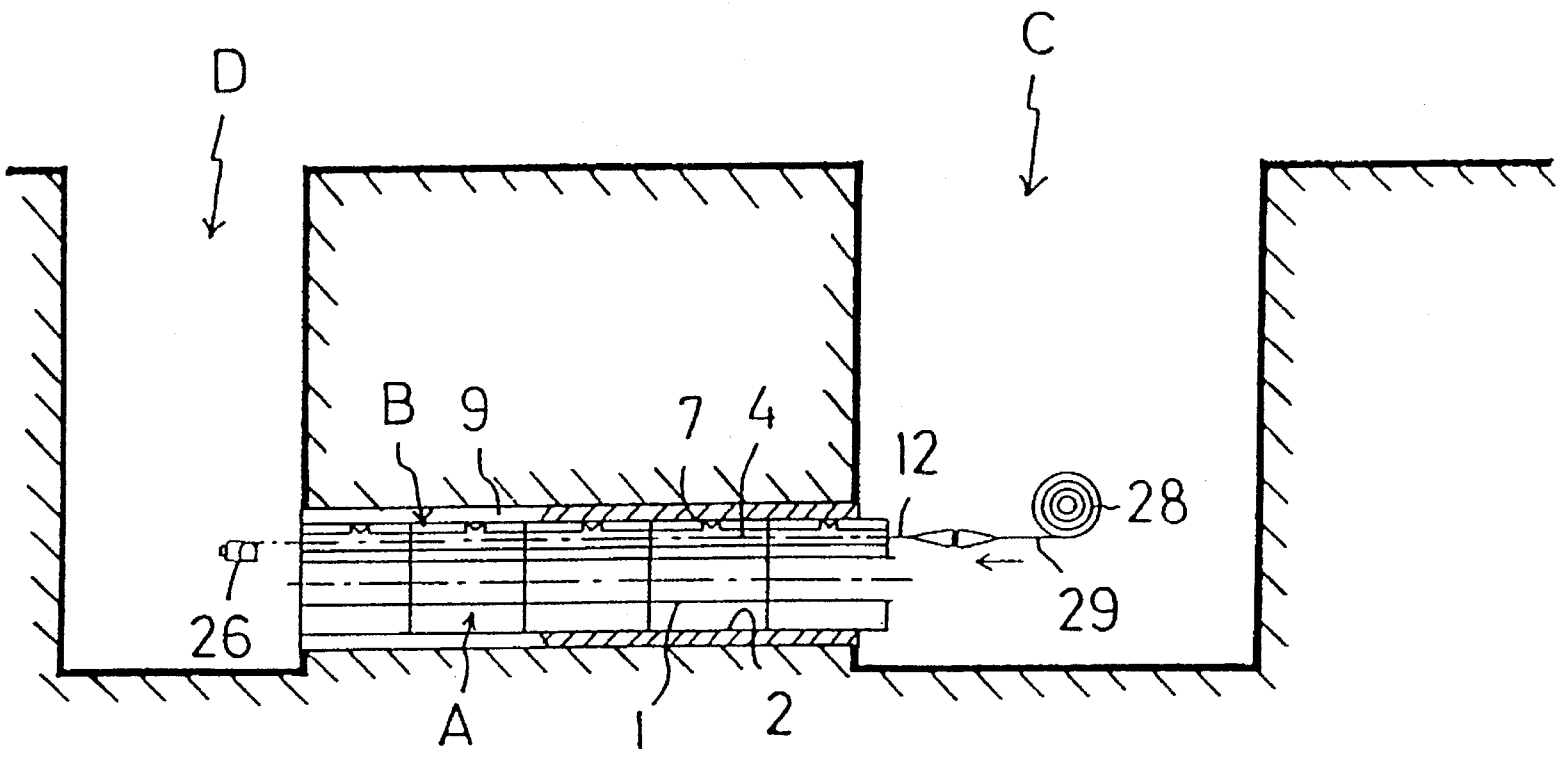
FIG. 17 is a view for illustrating a preparatory operation for injecting back-filling material into a space between the conduit and the ground with inserting a back-filling material supply pipe into a sheath pipe from a side of the other vertical shaft after injecting back-filling material into a space between the conduit and the ground with inserting the back-filling material supply pipe into the sheath pipe from a side of one vertical shaft.

As above-mentioned, the space 9 around a half portion of conduit B extending from approximately the center of conduit B toward the start vertical shaft C and the ground can be filled with back-filling material, and thereafter as shown in FIG. 17, wire reel 28 is equipped in start vertical shaft C, and auxiliary wire 29 wound on wire reel 28 is connected with wire 12. Auxiliary wire 29 is unwound by driving winch 26 equipped in arrival vertical shaft D so that the forward end of auxiliary wire 29 comes to arrival vertical shaft D.

Figure 18:
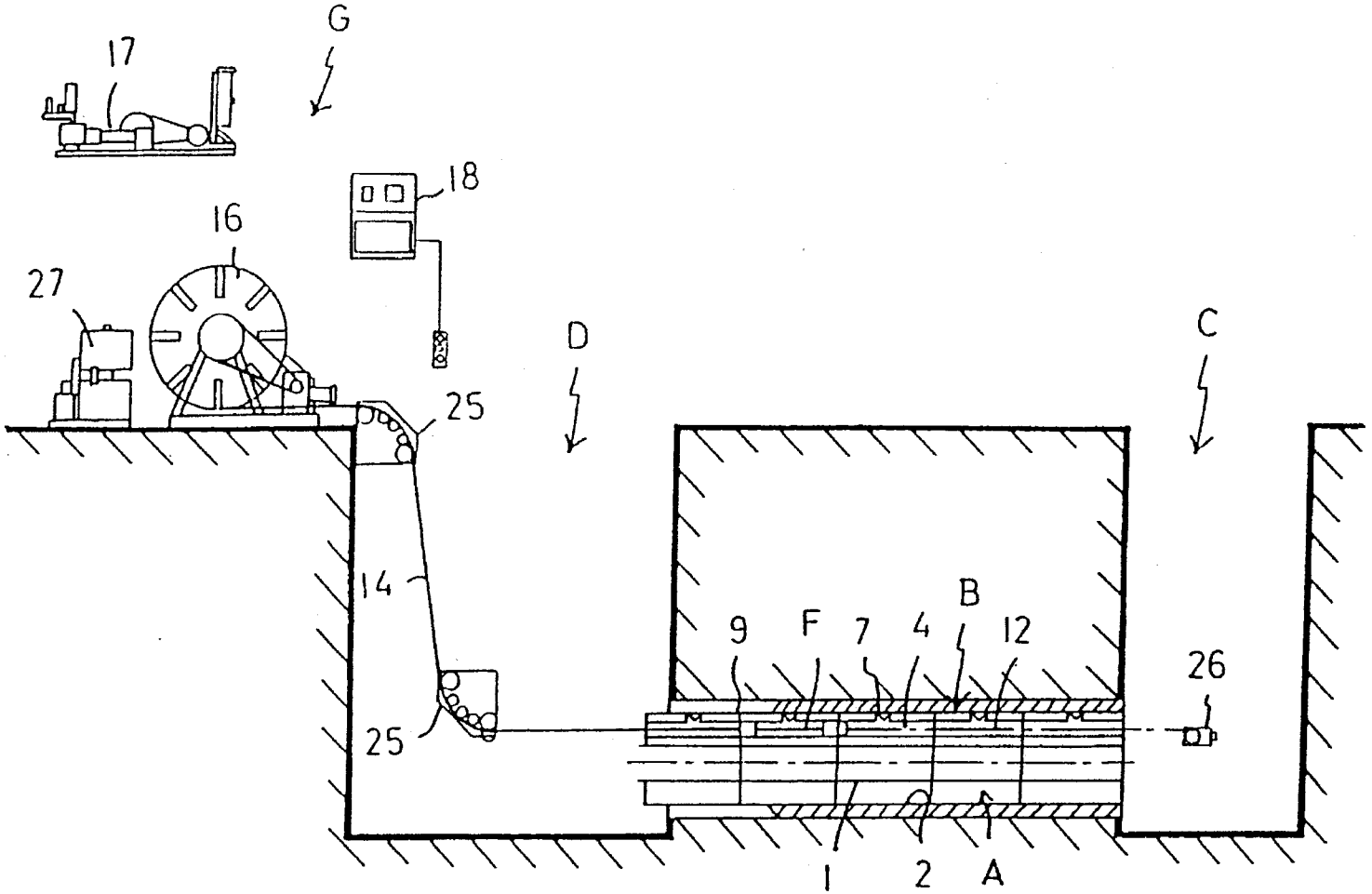
FIG. 18 is a view for illustrating a state where injection of back-filling material into a space between the conduit and the ground with inserting a back-filling material supply pipe into a sheath pipe is started.

Then, as shown in FIG. 18, winch 26 is equipped in starting vertical shaft C, while back-filling material feeder G in arrival vertical shaft D. After injecting member F is connected with wire 12, injecting member F and supply pipe 14 are inserted into sheath pipe 4 so that the forward end of injecting member F comes to nearly a center of conduit B and the forward end of injecting member F is opposed to check valve 7 provided in the double-wall pipe A adjacent to double-wall pipes A wherein space 9 between the double-wall pipes A and the ground has been filled with back-filling material, and back-filling material is injected through the check valve 7 into space 9 between outer pipe 2 of the first double-wall pipe A and the ground.

Figure 19:
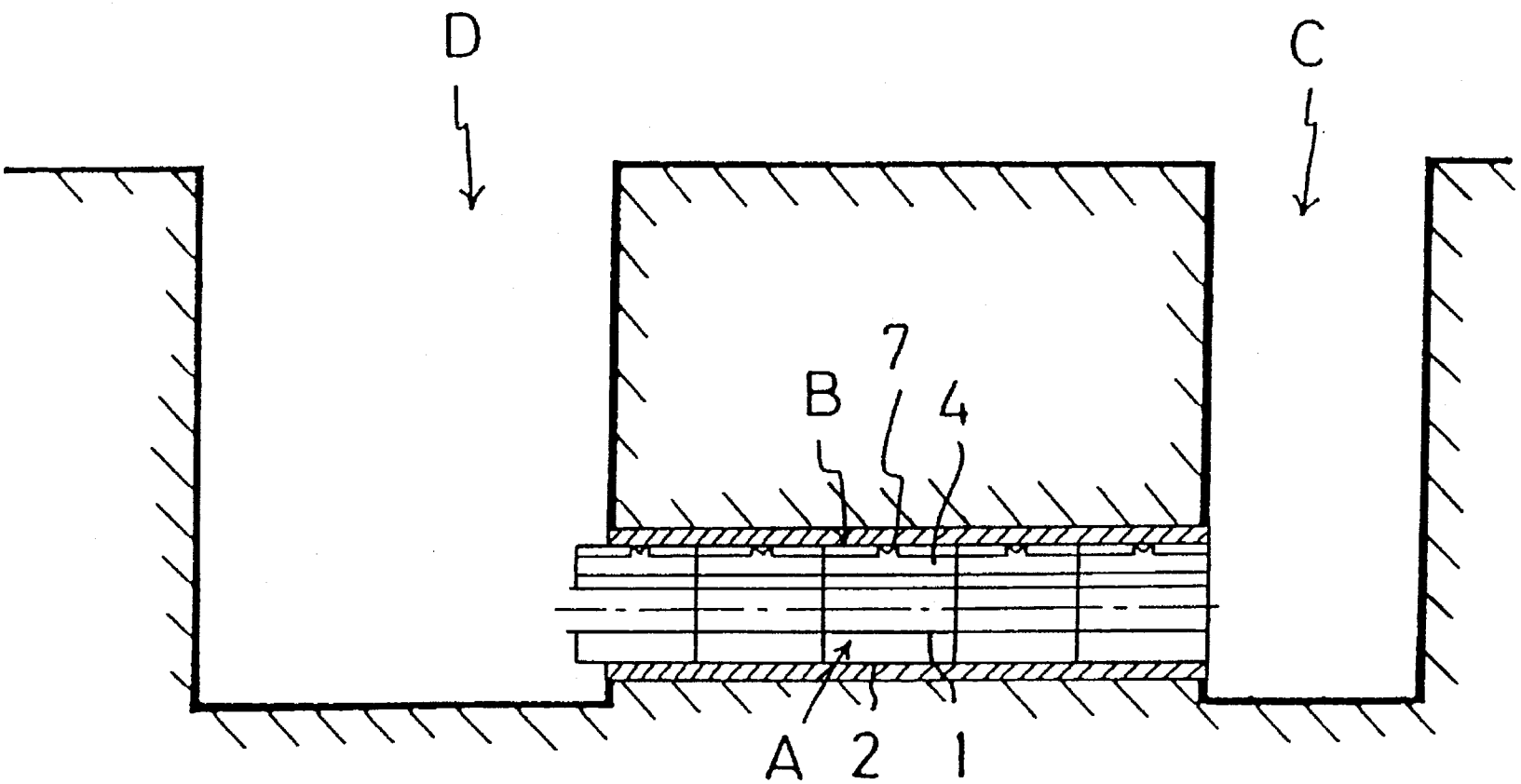
FIG. 19 is a view for illustrating a state where a space between the full conduit and the ground has been filled with back-filling material.

Then, the forward end of injecting member F is moved to positions at which the forward end of injecting member F is opposed to check valves 7 of second, third and other double-wall pipes A arranged on a side of arrival vertical shaft D one by one, and at the respective positions, back-filling material can be injected into space 9 between outer pipes 2 of double-wall pipes A and the ground over the full length of conduit B as shown in FIG. 19.

What is claimed is:

1. A method of injecting lubricant or back-filling material into a space between the outside of double-wall pipes and the ground in a pipe-jacking process in which the double-wall pipes are propelled by a pipe-jacking machine, wherein a conduit comprised of double-wall pipes each of which comprises an inner pipe and an outer pipe, is laid between a start vertical shaft and an arrival vertical shaft by propelling a tunneling machine followed by double-wall pipes by a pipe-jacking machine, the method comprising the steps of:

providing each double-wall pipe with a sheath pipe between an inner pipe and an outer pipe of each double-wall pipe and with an intermediate layer which is filled in a space between the inner pipe and the outer pipe in such a manner that ends of the inner pipe are not covered with the intermediate layer;

propelling a double-wall pipe to such a position that a backward end of the double-wall pipe is protruded into the start vertical shaft, and thereafter disposing a new double-wall pipe in the start vertical shaft, connecting an end of the double-wall pipe which has been propelled with an end of the new double-wall pipe, while connecting the sheath pipe of the double-wall pipe which has been propelled with the sheath pipe of the new double-wall pipe through a T-typed joint;

covering a space formed between an end of the double-wall pipe which has been propelled and an end of the new double-wall pipe, with the outer pipe of the new double-wall pipe or a covering member, mounting a check valve on the outer pipe or the covering member, and connecting the check valve with the T-type joint;

injecting back-filling material through a hole formed in outer pipes of respective double-wall pipes or the covering member into the space formed between an end of the double-wall pipe which has been propelled and an end of the new double-wall pipe so that the space formed between an end of the double-wall pipe which has been propelled and an end of the new double-wall pipe is filled with back-filling material;

inserting an injecting member into the sheath pipe of the new double-wall pipe, thereafter moving appropriately the injecting member in the sheath pipe, and injecting lubricant through the injecting member, and the T-typed joint into a space between the outside of the outer pipes or the covering member and the ground, while propelling the tunneling machine followed by double-wall pipes; and after having laid a conduit comprised of double-wall pipes, inserting an injecting member into the sheath pipe, injecting back-filling material in the sheath pipe and injecting back-filling material into a space between the outside of double-wall pipes and the ground through the T-type joint.

2. A method of injecting lubricant or back-filling material into a space between the outside of double-wall pipes and the ground in a pipe-jacking process in which the double-wall pipes are propelled by a pipe-jacking machine, wherein a conduit comprised of double-wall pipes, each of which comprises an inner pipe and an outer pipe, is laid between a start vertical shaft and an arrival vertical shaft by propelling a tunneling machine followed by double-wall pipes by a pipe-jacking machine, the method comprising the steps of:

providing each double-wall pipe with a sheath pipe between an inner pipe and an outer pipe of each double-wall pipe and with an intermediate layer which is filled in a space between the inner pipe and the outer pipe in such a manner that ends of the inner pipe are not covered with the intermediate layer, and mounting a check valve in an end of the outer pipe;

propelling a double-wall pipe to such a position that a backward end of the double-wall pipe is protruded into the start vertical shaft with the inner pipe projecting further rearwardly than the outer pipe, and thereafter disposing a new double-wall pipe in the start vertical shaft, said new double-wall pipe initially having ends of its inner and outer pipes disposed axially from one another so that the ends of the inner and outer pipes are initially spaced axially from one another, connecting an end of the inner pipe of the double-wall pipe which has been propelled with a projecting end of the inner pipe of the new double-wall pipe;

covering a space formed between an end of the inner pipe of the double-wall pipe which has been propelled and an end of the inner pipe of the new double-wall pipe, by propelling axially an outer pipe of the new double-wall pipe which is provided with the check valve until it contacts the outer pipe of said double-walled pipe which has been propelled;

inserting an injecting member into the sheath pipe of the new double-wall pipe, and thereafter moving appropriately the injecting member in the sheath pipe, and injecting lubricant through the injecting member and the check valve into a space between the outside of the outer pipes and the ground, while propelling the tunneling machine followed by double-wall pipes; and after having laid a conduit comprised of double-wall pipes, inserting an injecting member into the sheath pipe and injecting back-filling material into a space between the outside of the double-wall pipes and the ground through the check valve.

3. A method of injecting lubricant or back-filling material into a space between the outside of double-wall pipes and the ground by laying a conduit comprised of double-wall pipes in the ground by a pipe-jacking method in which the double-wall pipes are propelled by a pipe-jacking machine, each of said double-wall pipes comprising an inner pipe and an outer pipe and being provided with a sheath pipe into which a lubricant or back-filling material supply pipe is inserted, between the inner pipe and the outer pipe and with a check valve through which lubricant or back-filling material is injected into a space between the outside of the double-wall pipes and the ground in the outer pipe, the method comprising the steps of:

inserting a wire into the sheath pipe from one end thereof toward the other end thereof and the wire being connected with the lubricant or back-filling material supply pipe;

thereafter, putting the lubricant or back-filling material supply pipe in the sheath pipe by drawing the wire so that an outlet of the lubricant or back-filling material supply pipe is opposed to the check valve; and sending lubricant or back-filling material to the check valve through the sheath pipe and injecting lubricant or back-filling material through the check valve into a space between the outside of the double-wall pipes and the ground.

4. A method of injecting lubricant or back-filling material into a space between the outside of double-wall pipes and the ground as claimed in claim 3, wherein the lubricant or back-filling material supply pipe includes two packing means disposed at a given interval and an injecting member with an outlet disposed between the packing means, and the method further comprises the step of inflating the packing means when the injecting member comes to a position at which the injecting member is opposed to a check valve so that the inside of the sheath pipe is partitioned by the inflated packing means and fixing the injecting member.

5. A method of injecting lubricant or back-filling material into a space between the outside of double-wall pipes and the ground as claimed in claim 3, wherein lubricant or back-filling material is intermittently injected into the sheath pipe, while the lubricant or back-filling material supply pipe is moved in the sheath pipe.

6. A method of injecting back-filling material into a space between the outside of double-wall pipes and the ground in laying a conduit comprised of double-wall pipes in the ground by a pipe-jacking method as claimed in claim 5 wherein the back-filling material supply pipe includes two packing means disposed at a given interval and an injecting member with an outlet disposed between the packing means, and the method further comprises the step of inflating the packing means when the injecting member comes to a position at which the injecting member is opposed to a check valve so that the inside of the sheath pipe is partitioned by the inflated packing means and fixing the injecting member.

7. A method of injecting lubricant or back-filling material into a space between the outside of double-wall pipes and the ground as claimed in claim 3, wherein the lubricant or back-filling material supply pipe has an injecting member, and a cleaning member which contacts with the internal face of the sheath pipe is connected with the injecting member so that the internal face of the sheath pipe is cleaned by the cleaning member while the lubricant or back-filling material supply pipe is moved in the sheath pipe.

8. A method of injecting back-filling material into a space between the outside of double-wall pipes and the ground in laying a conduit comprised of double-wall pipes in the ground by a pipe-jacking method in which the double-wall pipes are propelled by a pipe-jacking machine, wherein a conduit comprised of double-wall pipes, each of which comprises an inner pipe and an outer pipe, is laid between a start vertical shaft and an arrival vertical shaft by propelling a tunneling machine followed by double-wall pipes by a pipe-jacking machine, the conduit is provided with plural check valves which are disposed at intervals, the method comprising the steps of:

inserting a back-filling material supply pipe provided with a back-filling material injecting member at the forward end thereof into a sheath pipe disposed between the inner pipe and outer pipe of the double-wall pipe, from one of the vertical shafts until an outlet of the back-filling material supply pipe arrives at a position at which the outlet of the back-filling material supply pipe is opposed to a central check valve disposed at about a center of the conduit;

injecting back-filling material through the central check valve into a space between the outside of the double-wall pipes and the ground;

thereafter moving toward another of the vertical shafts the back-filling material supply pipe until the back-filling material supply pipe reaches the next position at which the outlet of the back-filling material supply pipe is opposed to a next check valve adjoining the central check valve;

injecting back-filling material through the next check valve into a space between the outside of the double-wall pipes and the ground;

thereafter further moving toward the other vertical shaft the back-filling material supply pipe until the back-filling material supply pipe reaches other positions at which the outlet of the back-filling material supply pipe is opposed to other check valves while injecting back-filling material through said other check valves opposed to the outlet of the back-filling material supply pipe, and into a space between the outside of the double-wall pipes and the ground by which a space between the outside of the double-wall pipes and the ground is filled with back-filling material over about the half length of the conduit;

thereafter inserting the back-filling material supply pipe from the side of the other vertical shaft into the sheath pipe until an outlet of the back-filling material supply pipe reaches a position at which the outlet of the back-filling material supply pipe is opposed to an inner most check valve which is disposed at a farthest position from the center of the conduit in a part of the conduit wherein a space between the outside of the double-wall pipe and the ground is not yet filled with back-filling material;

injecting back-filling material through the inner most check valve into a space between the outside of the double-wall pipes and the ground;

thereafter moving toward one vertical shaft the back-filling material supply pipe in the sheath pipe until the back-filling material supply pipe reaches the next position at which the outlet of the back-filling material supply pipe is opposed to next check valve adjoining the inner most check valve;

injecting back-filling material through the next check valve into a space between the outside of the double-wall pipes and the ground;

thereafter further moving toward another of the vertical shafts the back-filling material supply pipe until the back-filling material supply pipe reaches positions at which the outlet of the back-filling material supply pipe is opposed to check valves disposed adjacent the next check valve, injecting back-filling material through the check valve opposed to the outlet of the back-filling material supply pipe into a space between the outside of the double-wall pipes and the ground by which a space between the outside of the double-wall pipes and the ground is filled with back-filling material over the full length of the conduit.

9. A method of injecting back-filling material into a space between the outside of double-wall pipes and the ground in laying a conduit comprised of double-wall pipes in the ground by a pipe-jacking method as claimed in claim 8, wherein back-filling material is intermittently injected into the sheath pipe, while the back-filling material supply pipe is moved in the sheath pipe.

10. A method of injecting back-filling material into a space between the outside of double-wall pipes and the ground in laying a conduit comprised of double-wall pipes in the ground by a pipe-jacking method as claimed in claim 8, wherein a cleaning member which is brought into contact with the inside of the sheath pipe is connected with the injecting member so that the inside of the sheath pipe is cleaned by the cleaning member while the back-filling material supply pipe is moved in the sheath pipe.

11. An apparatus for injecting lubricant or back-filling material into a space between the outside of double-wall pipes and the ground by laying a conduit comprised of double-wall pipes in the ground by a pipe-jacking method in which the double-wall pipes are propelled by a pipe-jacking machine, each of said double-wall pipes comprising an inner pipe and an outer pipe and being provided with a sheath pipe into which a lubricant or back-filling material supply pipe is inserted between the inner pipe and the outer pipe, and with a check valve through which lubricant or back-filling material is injected into a space between the outside of the double-wall pipes and the ground, the apparatus comprising a drum on which a lubricant or back-filling material supply pipe is wound, a drive for driving the drum, a lubricant or back-filling material supply apparatus connected with one end of the back-filling material supply pipe, and a winch on which a wire which is inserted into the sheath pipe and connected with the lubricant or back-filling material supply pipe to draw the lubricant or back-filling material supply pipe is wound.

12. An apparatus for injecting lubricant or back-filling material into a space between the outside of double-wall pipes and the ground in laying a conduit comprised of double-wall pipes in the ground by a pipe-jacking method as claimed in claim 11, wherein the winch is mounted in a tunneling machine.

13. An apparatus for injecting lubricant or back-filling material into a space between the outside of double-wall pipes and the ground in laying a conduit comprised of double-wall pipes in the ground by a pipe-jacking method as claimed in claim 11, wherein the outside of the lubricant or back-filling material supply pipe is graduated.

14. An apparatus for injecting lubricant or back-filling material into a space between the outside of double-wall pipes and the ground in laying a conduit comprised of double-wall pipes in the ground by a pipe-jacking method as claimed in claim 11, wherein the lubricant or back-filling material supply pipe is provided with packing means having tubes made of flexible material at the forward end of the lubricant or back-filling material supply pipe, the packing means are connected with a pressure fluid supply means so that a pressure fluid is supplied to the packing means to inflate the tubes thereof in such an extent that the tubes are brought into contact with the inside of the sheath pipe by which the packing means are fixed to the sheath pipe.

15. An apparatus for injecting lubricant or back-filling material into a space between the outside of double-wall pipes and the ground in laying a conduit comprised of double-wall pipes in the ground by a pipe-jacking method as claimed in claim 14, wherein the lubricant or back-filling material supply pipe is provided with two packing means which are disposed at an interval being equal to the length of a double-wall pipe to be propelled.

16. An apparatus for injecting lubricant or back-filling material into a space between the outside of double-wall pipes and the ground in laying a conduit comprised of double-wall pipes in the ground by a pipe-jacking method as claimed in claim 14, wherein the packing means are connected with a cleaning member for cleaning the inside of the sheath pipe.

17. An apparatus for injecting lubricant or back-filling material into a space between the outside of double-wall pipes and the ground in laying a conduit comprised of double-wall pipes in the ground by a pipe-jacking method as claimed in claim 16 wherein the cleaning member is made of flexible material and has a diameter being about equal to the inner diameter of the sheath pipe or more.

* * * * *